US006540211B2

(12) United States Patent
Tseng

(10) Patent No.: US 6,540,211 B2
(45) Date of Patent: Apr. 1, 2003

(54) CONTAINER FOR LIQUID OIL OF ENERGY

(76) Inventor: Jui-Tsun Tseng, No. 417-100, Sec. 4, Kung Hsueh Road, Tainan (TW)

( * ) Notice: Subject to any disclaimer, the term of this patent is extended or adjusted under 35 U.S.C. 154(b) by 0 days.

(21) Appl. No.: 09/850,111

(22) Filed: May 8, 2001

(65) Prior Publication Data

US 2002/0167095 A1 Nov. 14, 2002

(51) Int. Cl.[7] ..... B01F 3/04
(52) U.S. Cl. ..... 261/65; 261/122.1; 261/123
(58) Field of Search ..... 261/121.1, 122.1, 261/123, 65

(56) References Cited

U.S. PATENT DOCUMENTS 3,083,148 A * 3/1963 Mojonnier ..... 261/123
4,869,852 A * 9/1989 Goudy, Jr. et al. ..... 261/122.1
5,054,422 A * 10/1991 Nojima et al. ..... 261/123
5,335,785 A * 8/1994 Kawatra et al. ..... 261/122.1
5,380,471 A * 1/1995 Ban et al. ..... 261/122.1
5,736,072 A * 4/1998 Satoh ..... 261/123
6,202,991 B1 * 3/2001 Coniglio et al. ..... 261/121.1

* cited by examiner

*Primary Examiner*—C. Scott Bushey
(74) *Attorney, Agent, or Firm*—Bacon & Thomas, PLLC

(57) ABSTRACT

A container for liquid oil of energy includes a container body, a top cover and a bottom cover. The container body is made of aluminum squeezed into a tubular shape with a hollow interior and provided with plural vertical support posts and a vertical projection fitted with a gasification box. The top cover and the bottom cover are respectively fitted on the top edges and the bottom edges of the support posts. The top cover is fixed with a stop valve and an air filling pump functioning to turn off power. Then, the bottom side of the stop valve is connected with an air intake pipe extending into the gasification box. The oil container of such design is easy in manufacturing, possible to lower manufacturing cost and capable to permit the oil and air inside mixed completely to elevate the degree of gasification and density of oil gas.

5 Claims, 29 Drawing Sheets

A–A

B–B

C-C

CONTAINER FOR LIQUID OIL OF ENERGY

BACKGROUND OF THE INVENTION

This invention relates to a container for liquid oil of energy, particularly to one easy in manufacturing, convenient in using, elegant in appearance, possible to lower cost of manufacturing and render the oil and air inside mixed together completely to elevate degree of gasification and density of the oil gas.

Conventionally, such liquid oil of energy as petrochemical fuel oil, liquid gas and the like are generally filled in a steel container (so-called a steel gas container). The steel container 30, as shown in FIG. 1, is provided with a control valve 301 on top, and the control valve 301 includes a gas exhausting valve 302 for sending out oil gas, an air intake valve 303 for injecting air into the steel container 30 to be mixed with the oil inside and an air intake pipe 304 (if necessary).

In addition, as the oil injected into the steel container is highly compressed and easy to burn to give rise to an accident, the steel container must be resistant against high pressure and capable to prevent erosion so as to avoid any accident possibly caused by overflowing of the oil gas. So the conventional steel container for liquid oil of energy is generally made of a thick steel board which is repeatedly crushed into a cylinder shape by rollers and then welded into a tubular body, and, after the tubular body is cut into a proper height, it is welded together with a top and a bottom members, thus forming a steel gas container of great strength, resisting high pressure and preventing erosion.

However, such known conventional steel gas container has some defects described below.

1. Such a conventional steel gas container is made of a thick steel board, resulting in increasing cost of material and the aforesaid thick steel board must be repeatedly pressed and welded to be formed into shape, complicating procedure and enhancing cost of processes.

2. The whole body of the steel gas container is made of a thick steel board of heavy weight, uneasy to be carried around and impossible to be hung on a wall.

3. The appearance of the steel gas container has no esthetic impression at all due to the welding marks left on the container and its monotonous, upright tubular shape.

SUMMARY OF THE INVENTION

The objective of the in vent ion is to offer a container for liquid oil of energy, easy in manufacturing, convenient in using, elegant in appearance, possible to lower cost of manufacturing, and capable to allow the oil and gas inside mixed together completely so as to elevate degree of gasification and density of oil gas.

In order to reach such goal, the container for liquid oil of energy in this invention is designed in particular. The oil container in this invention is composed of a container body, a top cover and a bottom cover combined together.

The container body is made of aluminum squeezed into a tubular shape having a hollow interior with its topside communicating with its bottom side. Plural support posts and a vertical dovetail-shaped projection are disposed on the inner walls of the container body for the top cover and the bottom cover to be fixed stably thereon, and then a gasification box is fitted on the outward side of the dovetail-shaped projection in the container body.

The top cover matching with the hollow interior of the container body has a stepped surface and is fitted stably on the support posts and the dovetail-shaped projection. Then, the top cover is provided with an air exhausting nozzle and an oil-injecting pipe on top, the air exhausting mouth connected with a ramifying controlling box with plural ramifying passage ways. Besides, a stop valve conforming to the gasification box is provided on the top cover, and an air pump is positioned at a lower stepped surface of the top cover, the air exhausting pipe of the air filling pump connected to the stop valve having its bottom extending in the interior of the container body to connect with a second stop valve, and then an air intake pipe is connected to the bottom side of the second stop valve and has its other end extending to the bottom of the gasification box and fitted with an air exhausting sleeve capable to form extremely minute and dense bubbles.

The bottom cover matching with the hollow interior of the container body is formed slanting to one side facing the air intake pipe, secured on the bottom edges of the support posts, and provided with a groove aligned with the air intake pipe and the air-exhausting sleeve.

Assembled in such way as described above, the container for liquid oil of energy in this invention is completely finished.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
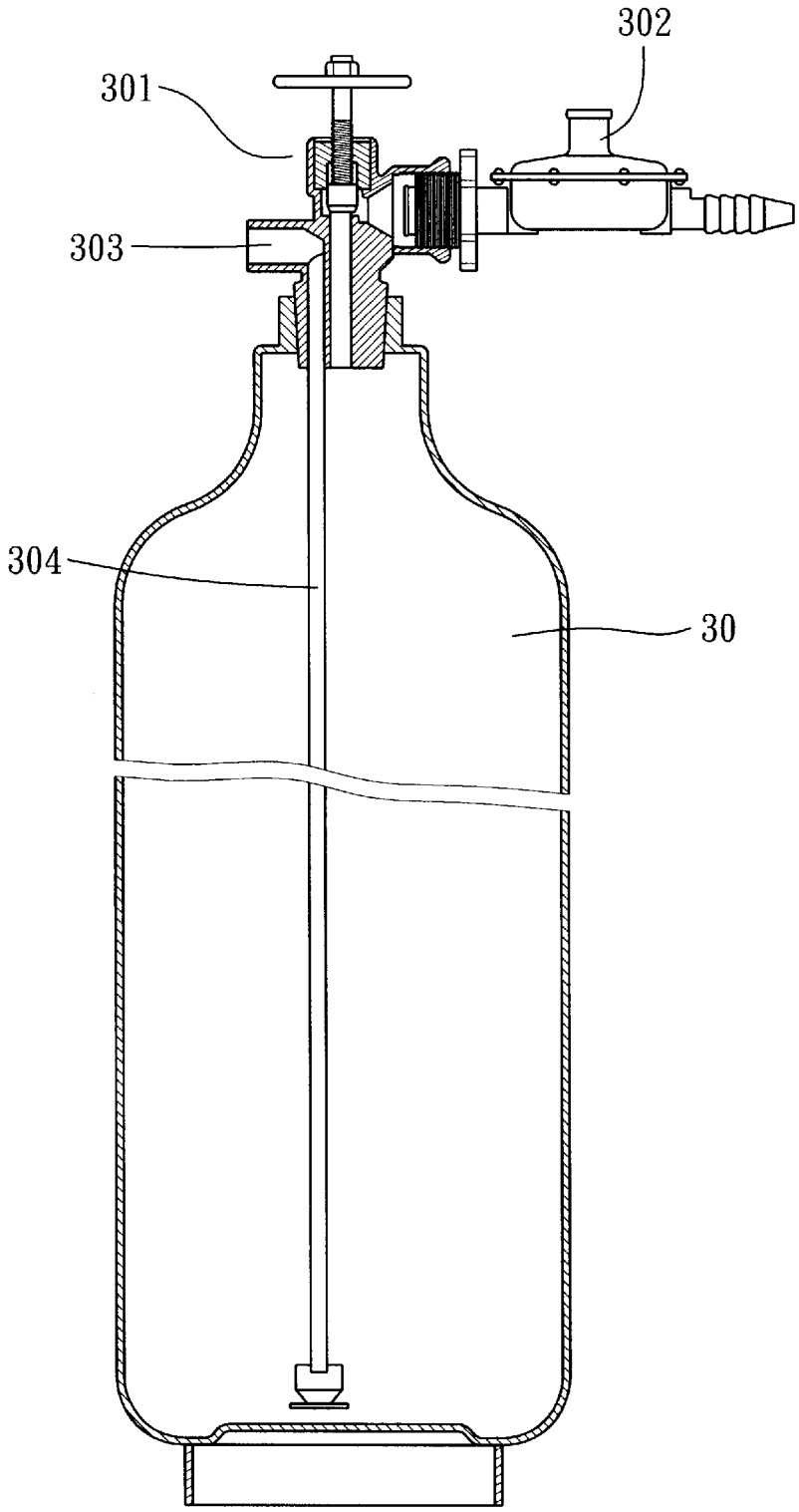
FIG. 1 (PRIOR ART)
FIG. 1 is a cross-sectional view of a known conventional steel gas container.
Figure 2:
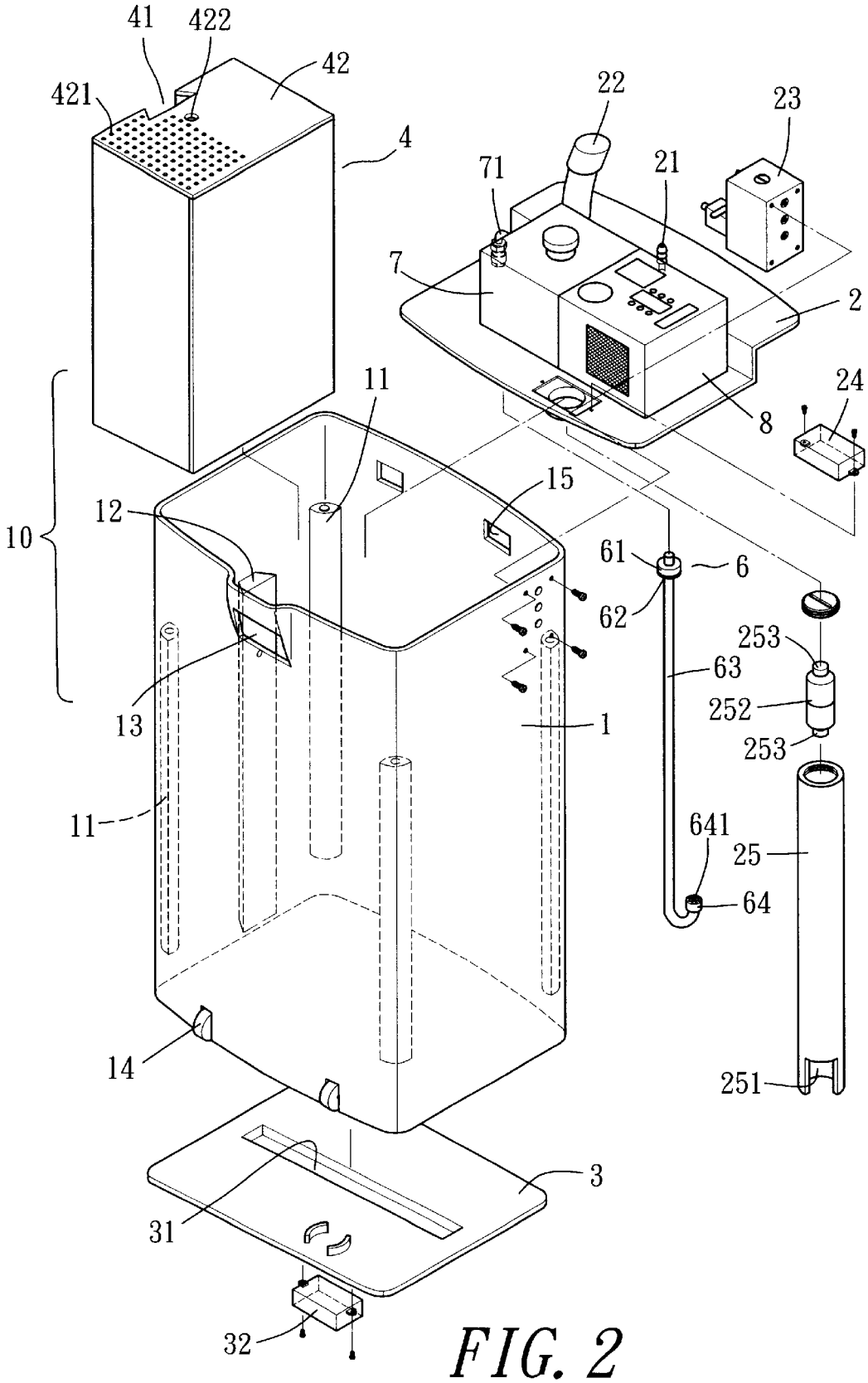
FIG. 2 is an exploded perspective view of a container for liquid oil of energy in the present invention.

A preferred embodiment of a container 10 for liquid oil of energy in the present invention, as shown in FIGS. 2, 3, 4, 5, 6, 7 and 8, includes a container body 1, a top cover 2 and a bottom cover 3 as main components firmly combined together.

The container body 1 is made of aluminum squeezed into a tubular shape having a hollow interior with its top side communicating with its bottom side and can be cut into different sizes to suit to various capacities. Plural support posts 11 and a pigeon tail-shaped projection 12 are vertically disposed on the inner walls of the container body 1 (the support posts possible to be formed hollow to save material). The support posts 11 and the engage projection 12 are formed integral with the container, and, cut short to let their top and bottomed edges able to be positioned within the container body 1. Then, an expanding out portion with an opening 13 is blow formed near the top edge of the front wall of the container body 1 after the container body 1 is cut into a proper size, and plural sliding wheels 14 are pivotally provided under the bottom and hang holes 15 are bored spaced apart near the top edge of the rear wall of the container 1.

Figure 3:
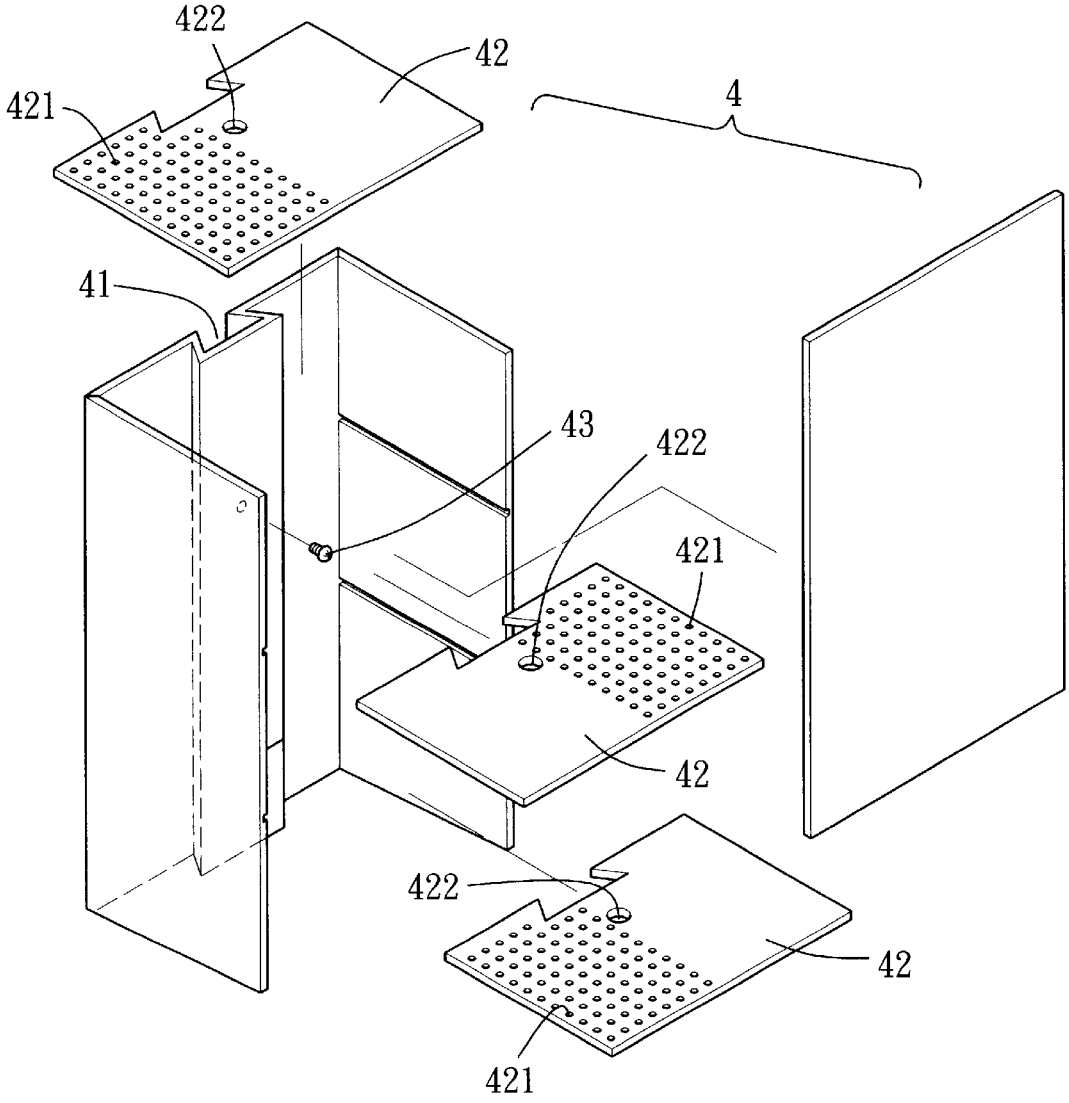
FIG. 3 is an exploded perspective view of a gasification box in the present invention.
Figure 4:
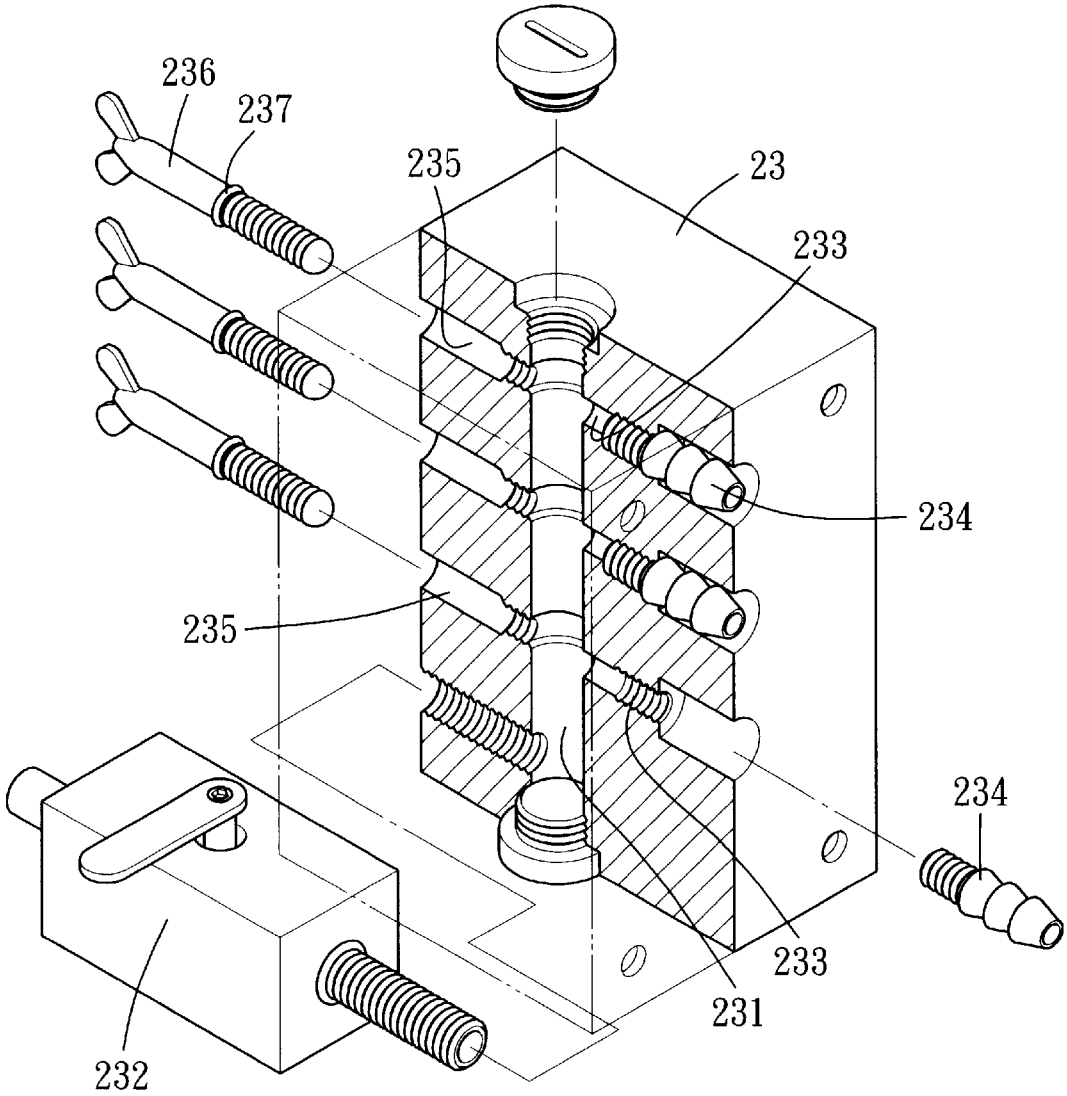
FIG. 4 is an exploded perspective view of a ramifying control box in the present invention.

Further, a gasification box 4 having an open bottom, as shown in FIG. 3, is fitted in the container body 1, as shown in FIG. 3, and a vertical dovetail-shaped engage groove 4 conforming to the engage projection 12 in the container body 1 formed on the inner wall of the gasification box 4 which is divided into several chambers by plural horizontal separating plates 42, with each upper and lower separating plate 42 respectively bored with numerous air releasing holes 421 on a half portion but not facing each other and with a vertical through hole 422 communicating with one another.

The top cover 2 matching with the hollow interior of the container body 1 is formed into a stepped cover body and fitted properly on the support posts 11 and the engage projection 12 inside the container body 1. Then, an air exhausting mouth 21 and an oil injecting pipe 22 are provided on the high stepped portion of the top cover 2 and the air nozzle 21 is connected to a shunt control box 23 which is disposed on the top cover 2 and also secured stably on the inner wall of the container body 1. Further, the shunt control box 23, as shown in FIG. 3, is formed integral with a main air intake passage 231 having its lower end assembled with a control valve 232 connected to the air nozzle 21 of the top cover 2, and the main air intake passageway 231 inside the ramifying control box 23 branches into plural ramifying passageways 233 at one side respectively fitted with a ramifying air nozzle 234 for soft pipes to insert therein. Besides, plural stop threaded holes 235 communicating with the ramifying passageways 233 are formed at the other side of the main air intake passageway 231, each having a stop bolt 236 threadably engaging the passageway 233 for blocking it, and each stop bolt 236 having a gasket 237 fitted around its body.

Figure 5:
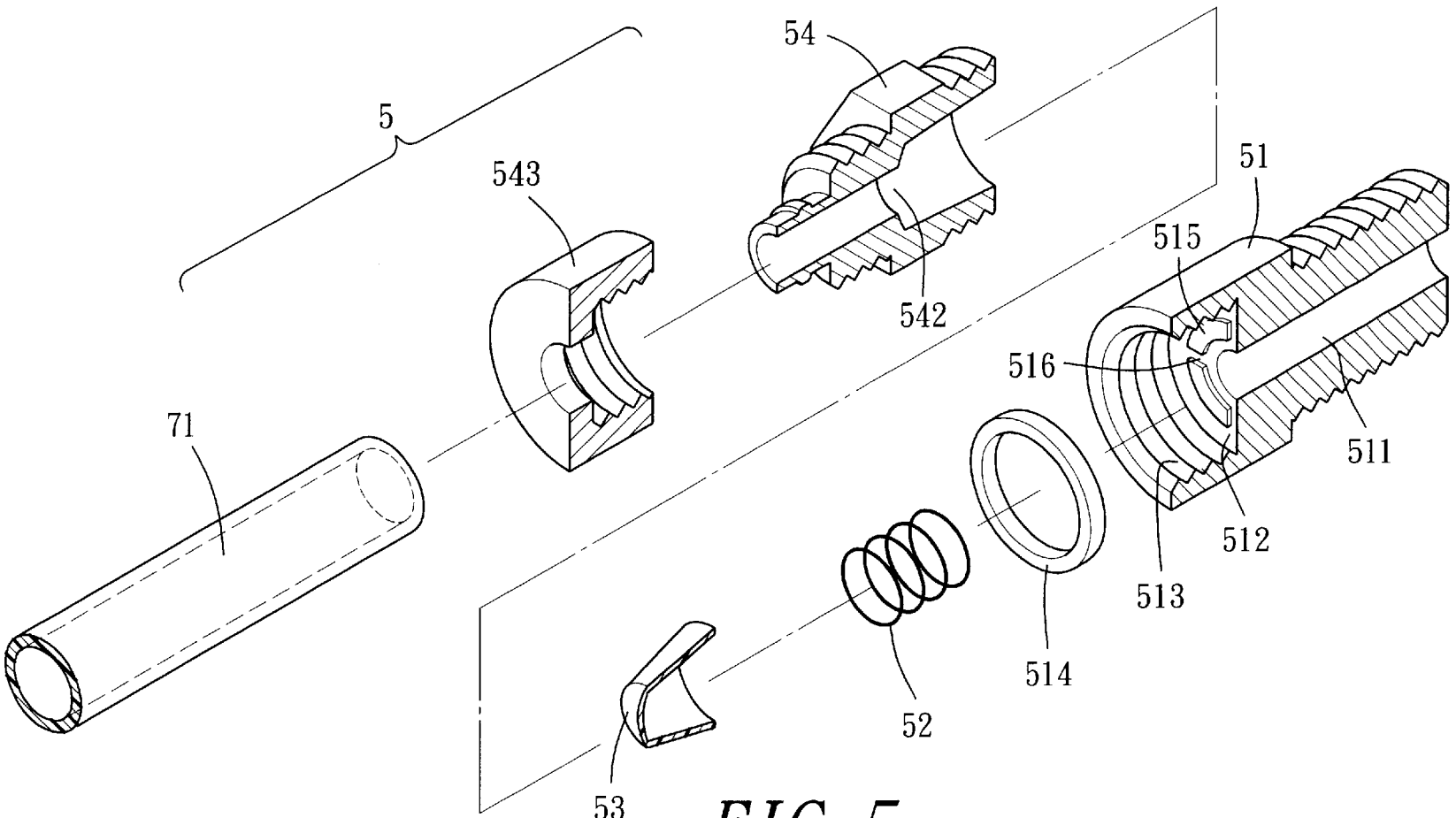
FIG. 5 is an exploded perspective view of a first stop valve in the present invention.

In addition, a stop valve 5 corresponding to the through hole 422 of the gasification box 4 in the container body 1 is provided on the top cover 2, as shown in FIG. 5. The stop valve 5 consists of a stop connecter 51 and a gas intake connecter 54. The stop connecter 51 threadably engaging the top cover 2 has a communicating passageway 511 formed inside and an inner stepped surface 512 formed in one side opposite to the top cover 2, having female threads 513 formed around and an annular gasket 514 positioned inside and also an annular projection 515 with several notches 516 bored spaced apart for a spring 52 to fit therein, and the spring 52 covered by a stop cap 53 with its opening facing the through passageway 511.

The air intake connecter 54 to be threadably assembled with the stop connecter 51 also has a through passage 54 1 formed inside and a groove 542 bored in one end facing the top cover 2 for receiving the same shaped stop cap 53 and the other end is connected with an air intake pump 6 on the top cover 2.

Figure 6:
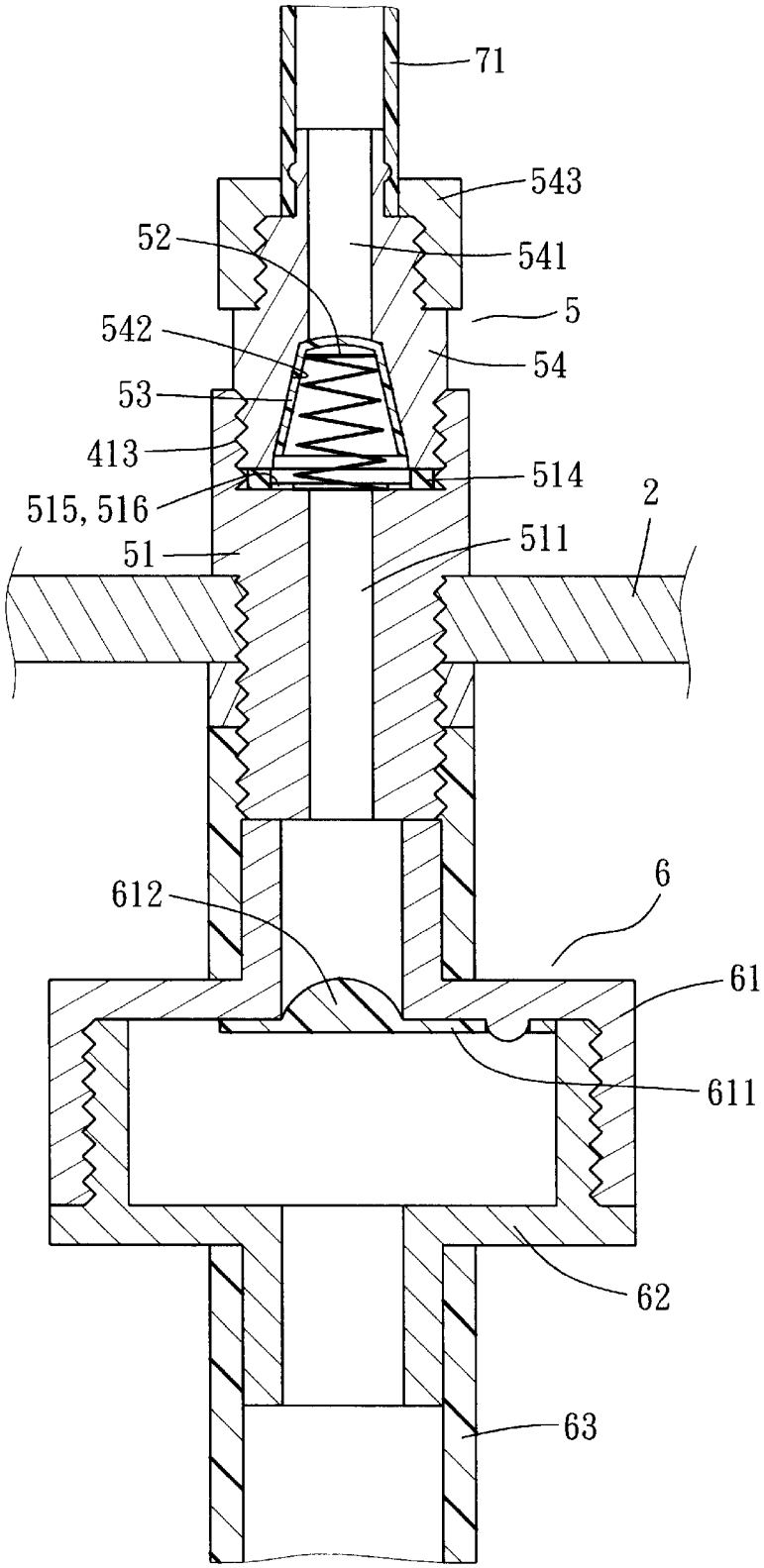
FIG. 6 is a cross-sectional view of a combination of the first and a second stop valves in the present invention.
Figure 7:
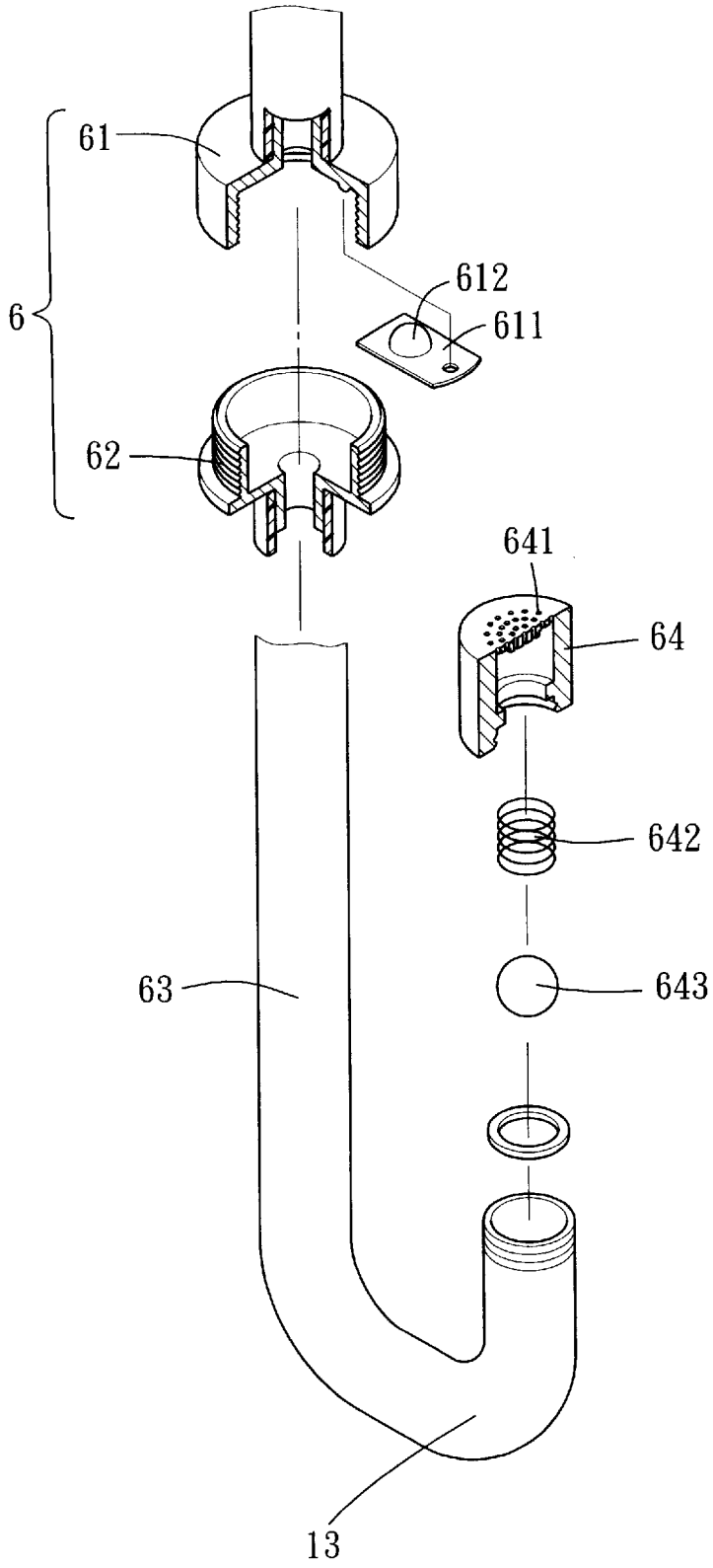
FIG. 7 is an exploded perspective view of the second stop valve and its air intake pipe in the present invention.

When the air intake connecter 54 is threadably engaged on the stop connecter 51, as shown in FIG. 6, the air intake connecter 54 rests against the gasket 514 in the stop connecter 51, forming a closed condition, and the spring 52 pushes up the stop cap 53 to close up the outlet of the through passageway 541 inside the air intake connecter 54. Besides, the stop connecter 51 of the stop valve 5 extends through the top cover 2 into the interior of the container body 1 and connects with a second stop valve 6, as shown in FIG. 7.

Figure 8:
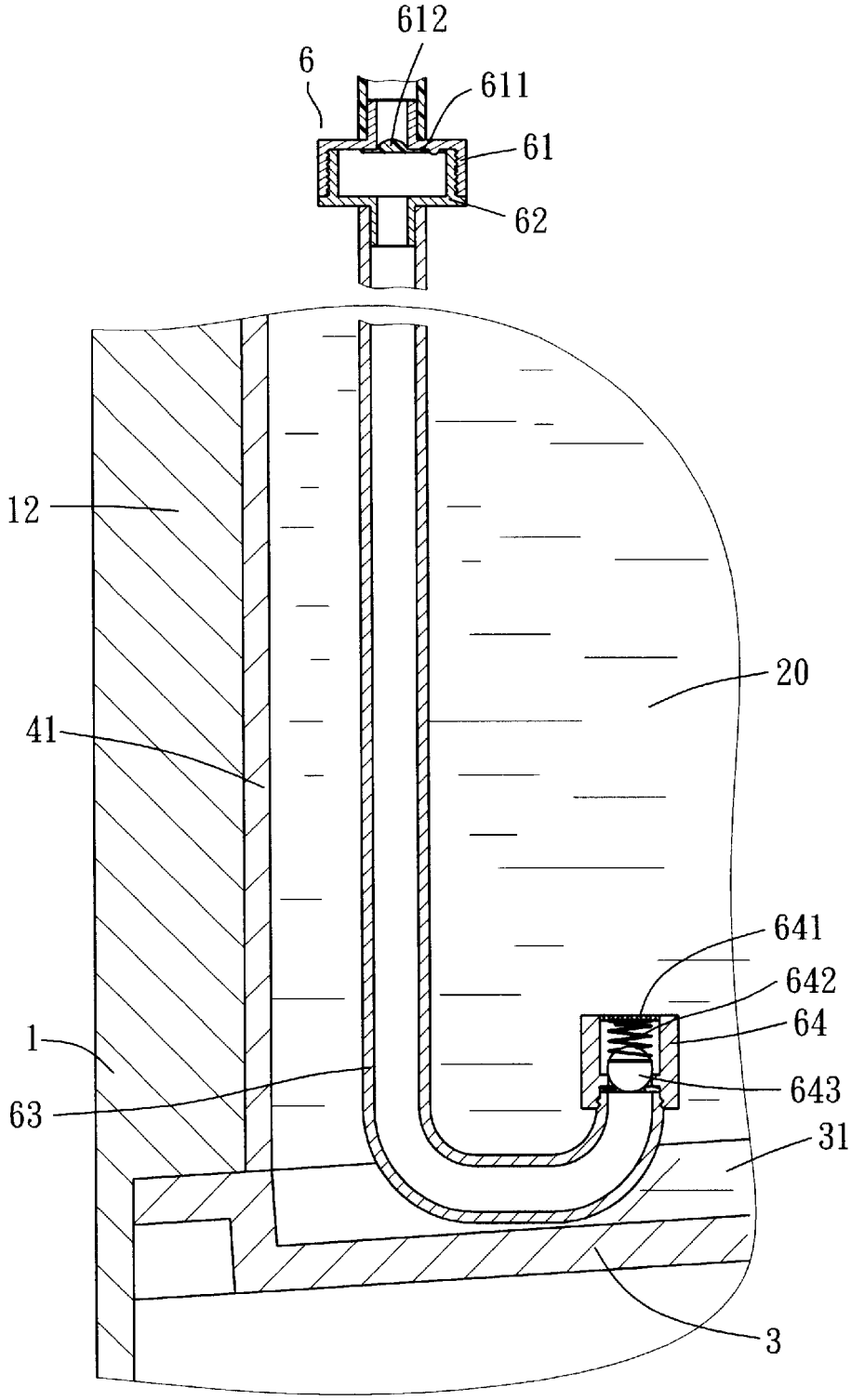
FIG. 8 is a cross-sectional view of the second valve and its air intake pipe combined together in the present invention.

The second stop valve 6 consists of an upper and a lower cover body 61 and 62 threadably combined together. The upper cover body 61 is provided with an openable soft pad 611 at bottom having a projection 612 on top for closing up the passageway of the upper cover 61. The lower cover body 62 has its bottom end connected with a gas intake pipe 63, which extends through the through holes 422 of the separating plates 42 of the gasification box 4 to reach under the lowermost separating plate 42. Then an air exhausting sleeve 64 is threadably fixed on the upward end of the air intake pipe 63, having a great number of minute holes 641 communicating with the air intake pipe 63 and a coil spring 642 positioned inside to push a ball 643 to close up the outlet at the end of the air intake pipe 63, as shown in FIG. 8.

Figure 9:
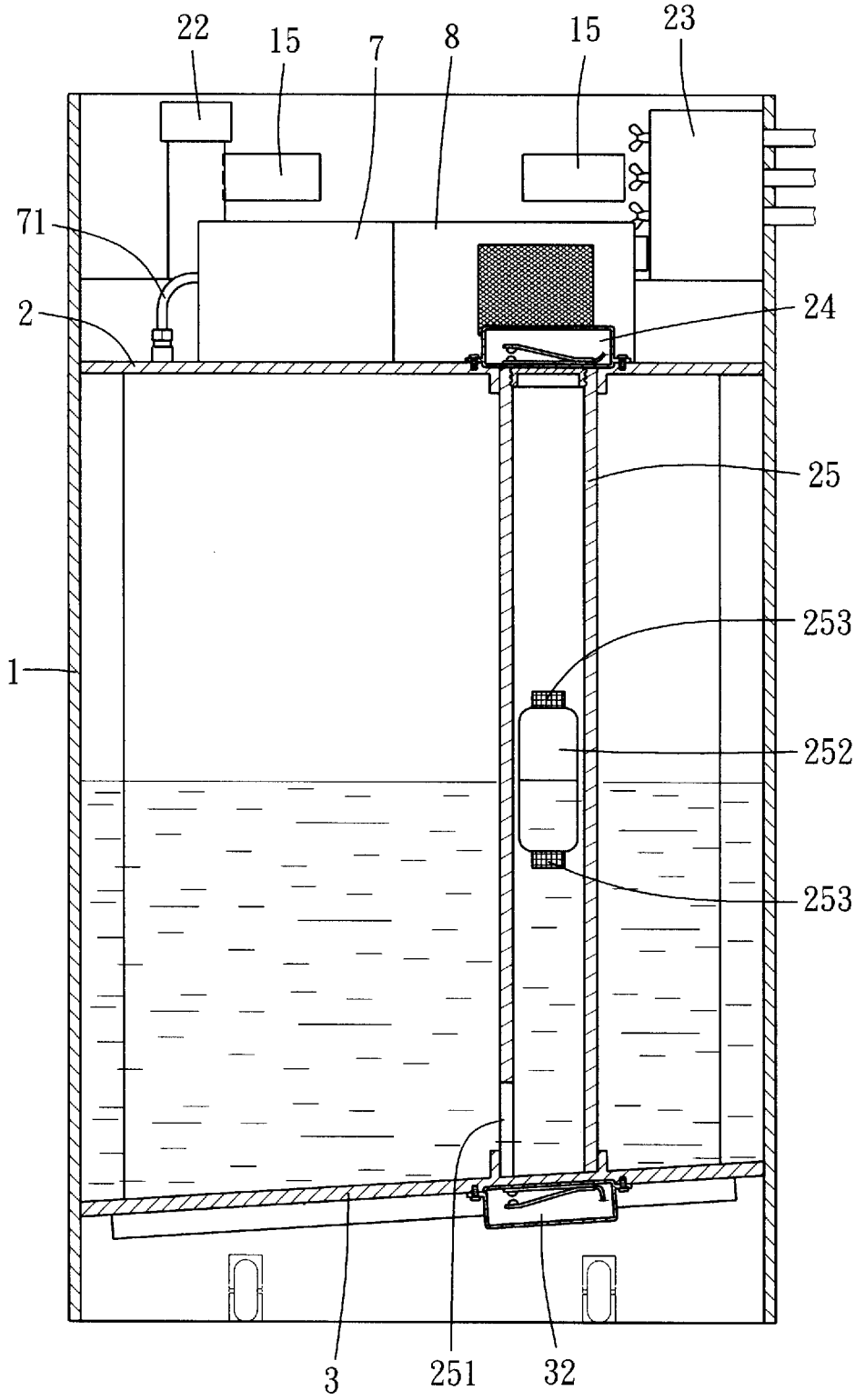
FIG. 9 is a cross-sectional view of a quantity detecting tube in the present invention.

In addition, an air intake pump 7 and an alarm device 8 are respectively secured on a lower stepped portion of the top cover 2. The air exhausting pipe 71 of the air intake pump 7 is connected to the air intake connecter 54 of the stop valve 5, and the alarm device 8 consists of an indicating lamp, a pressure gauge, a quantity warning alarm and a leakage alarm, capable to serve as a radio for listening to music or news additionally, the quantity warning alarm of the alarm device 8 is connected to a contact switch 24 secured on the top cover 2, as shown in FIG. 9. Then, a quantity detecting tube 25 conforming to the bottom side of the contact switch 24 inserts into the interior of the container body 1 and reaches the bottom cover 3, having an inlet 251 at lower side and a buoy 252 positioned inside with its top and bottom respectively fixed with a magnet 253.

The bottom cover 3 is an inclined body slanting downward to one side and facing the engage projection 12, fixed on the bottom ends of the support posts 11 in the container body 1. Further, the bottom cover 3 has a groove 31 bored exactly facing the air intake pipe 63 and the air exhausting sleeve 64 in the gasification box 4 and a contact switch 32 fixed under the bottom of the quantity detecting tube 25, as shown in FIG. 9, having its circuit connected to the quantity warning alarm of the alarm device 8 of the top cover 2.

Figure 10:
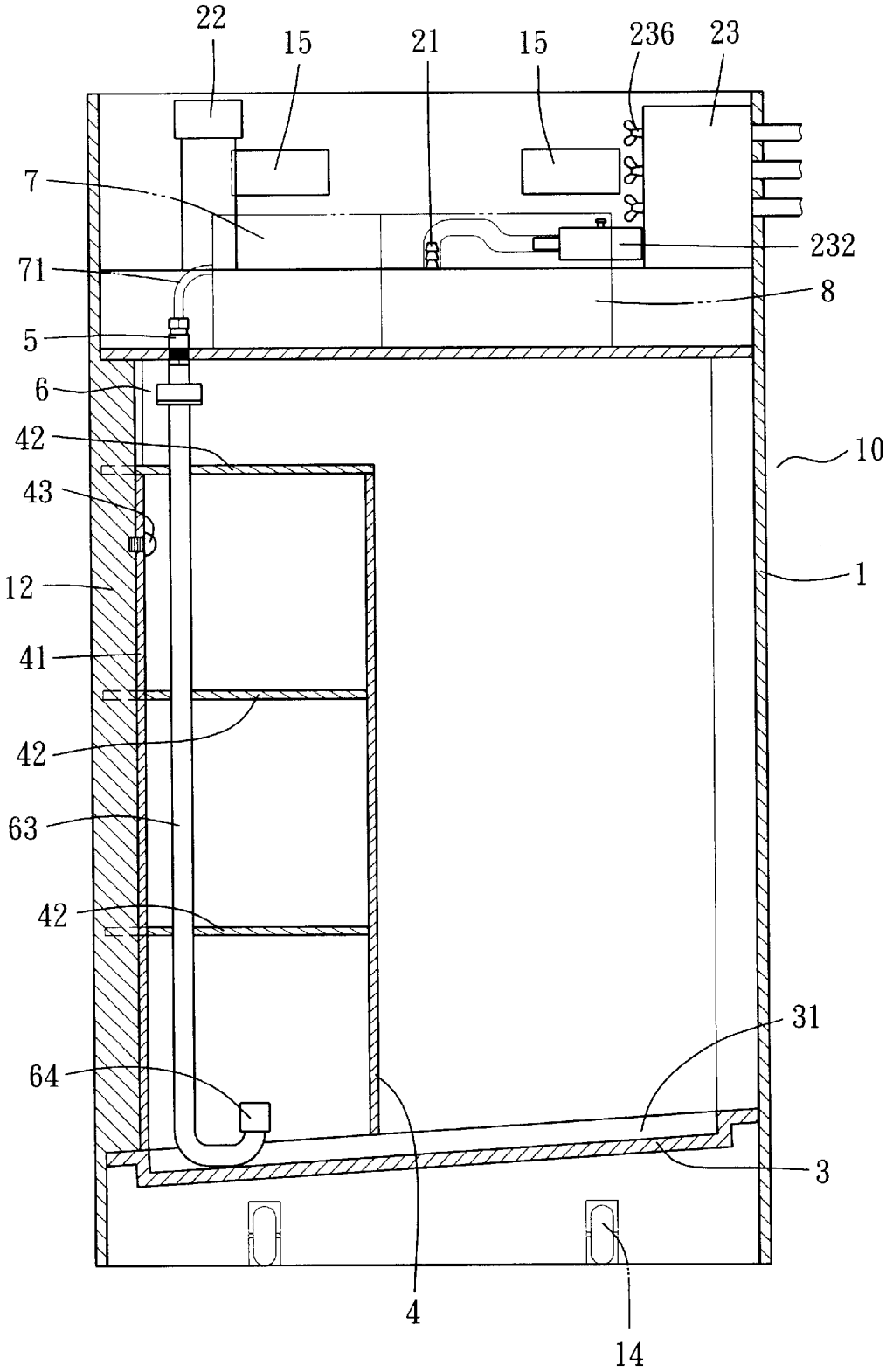
FIG. 10 is a cross-sectional view of a container for liquid oil of energy in the present invention.
Figure 11:
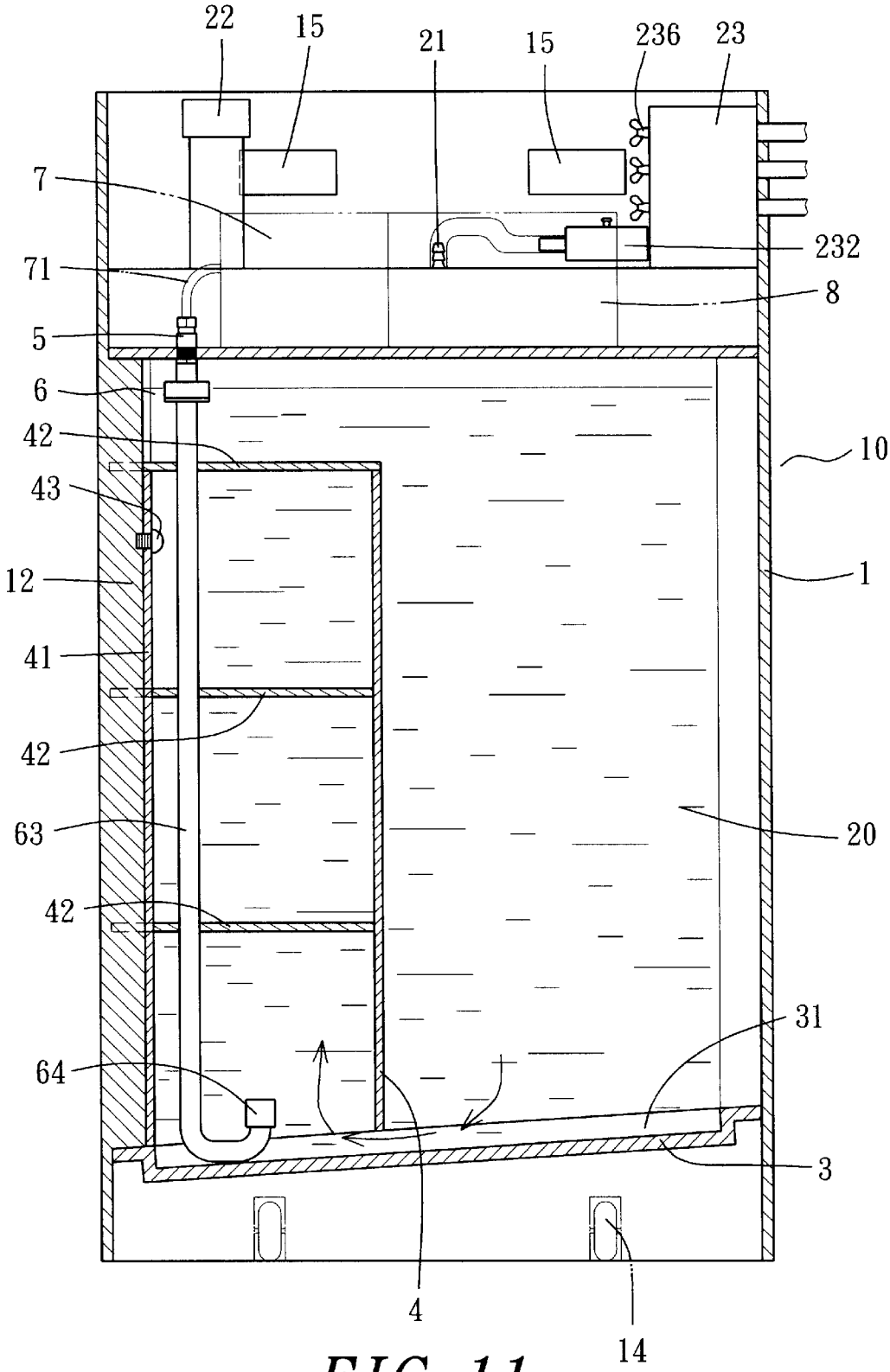
FIG. 11 is a cross-sectional view of the container filled with liquid oil without air injected in the present invention.

In assembling, as shown in FIG. 10, firstly the gasification box 4 is fitted in the container body 1, with the vertical dovetail-shaped groove 41 engaged with the dovetail-shaped projection 12, and then the gasification box 4 is assembled stably with the container body 1 by means of a screw 43 screwing through the inner wall of the vertical groove 41 of the gasification 4 into the engage projection 12 of the container body 1.

Next, the top cover 2 and the bottom cover 3 are respectively fitted on the top ends and the bottom ends of the support posts 11 in the container body 1, and the through passageway 511 of the stop connecter 51 of the stop valve 5 is connected to the upper cover body 61 of the second valve 6, and then the air intake connecter 54 of the stop vale 5 is fixedly connected with the air exhausting pipe 71 of the air intake pump 7 by means of a nut 543, as shown in FIG. 5 and 6.

Subsequently, the air intake pipe 63 connected to the lower cover body 62 of the second valve 6 passes through the through holes 422 of the separating plates 42 of the gasification box 4 to reach under the lowermost separating plate 42, with its two ends respectively fixed stably with the top and the bottom covers 2 and 3 of the container body 1 either by fusing or welding.

Figure 13:
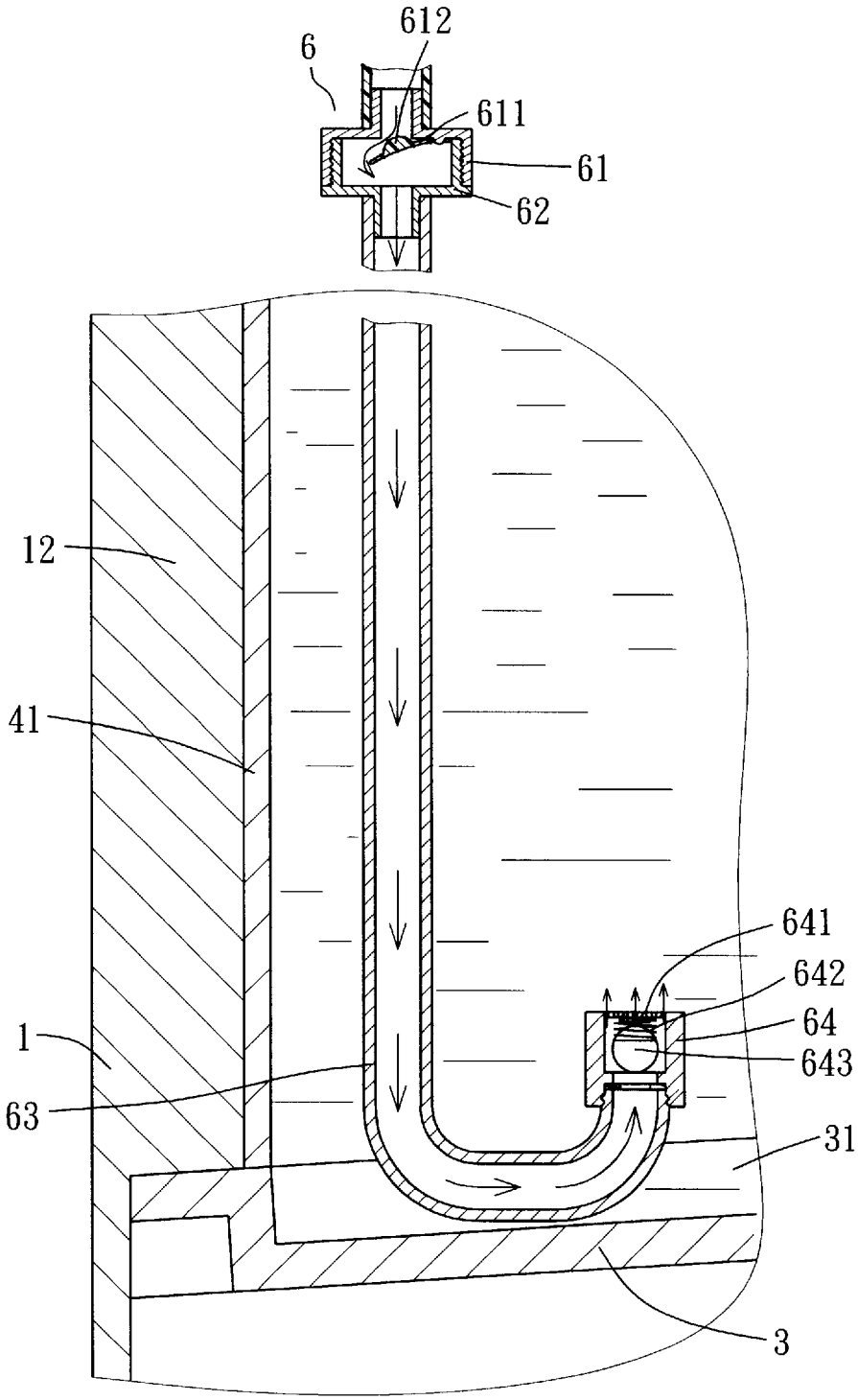
FIG. 13 is a cross-sectional view of the air intake pipe in motion in the present invention.

Lastly, after the top cover 2 is assembled in the container body 1, the air intake pump 7 and the alarm device 8 are disposed on the top cover 2, the control valve 232 of the ramifying control box 23 is connected to the air nozzle 21 of the top cover 2, and after all the ramifying air nozzles 234 of the shunt passages 233 protrude out of the container body 1, the ramifying control box 23 is horizontally positioned on the top cover 2 and threadably secured together, thus completing a closed container 10 for liquid oil of energy, as shown in FIGS. 10 and 13.

In the finished container 10, the air-exhausting sleeve 64 at the end of the air intake pipe 63 is located within the groove 31 of the bottom cover 3, and the bottom edge of the gasification box 4 rests on the bottom cover 3. Thus, the container body 1 and the gasification box 4 are communicating with each other, and the air nozzle 234 of the ramifying control box 23 are to be fitted by soft tubes connecting to gas ovens, heating systems and the like in a house.

In using, firstly, a proper amount of energy liquid oil 20 is filled into the container 10 and subsequently inject in air to be mixed with the liquid oil inside to form high-pressure oil gas of a proper proportion for use.

Specifically, referring to FIG. 10, a proper amount of energy liquid oil 20 is filled into the container 10 in advance, but remaining a space is reserved between the surface of the oil 20 and the top cover 2. The oil in the container 10 will flow into the gasification box 4 along the groove 31 of the bottom cover 3 and fill up the gasification box 4, and at the same time, the oil 20 will continue flowing into the quantity detecting tube 25 through the inlet 251 under the detecting tube 25, and the buoy 252 in the detecting tube 25 will float on the oil, and the more oil 20 is added in, the higher position the buoy 252 floats to.

Figure 12:
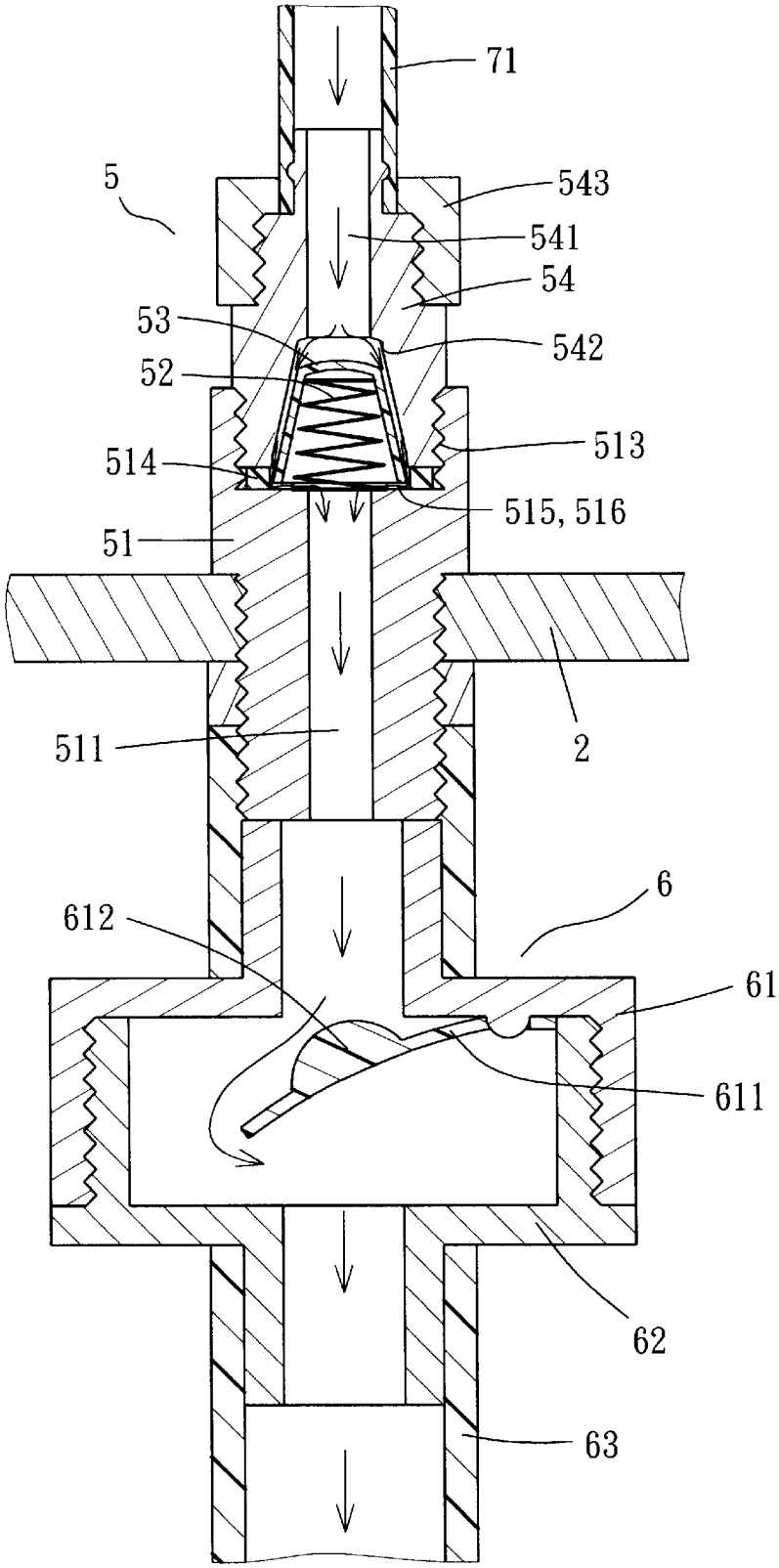
FIG. 12 is a cross-sectional view of the two stop valves in motion in the present invention.

Then start the air intake pump 7 to permit air pass through the air exhausting pipe 71 and the first valve 5 as well as the second valves 6 into the air intake pipe 63, referring to FIG. 12. After the air is compressed in the pump 7 to form a current of air, this current of air will flow through the exhausting pipe 71 toward the first stop valve 5 and push apart the stop cap 53 at the outlet of the through passageway 541 of the air intake connecter 54, and at the same time, the coil spring 52 is pressed and contracted forming a gap between the through passageway 541 of the air intake connecter 54 and the stop cap 53, so that the current of air may pass through this gap and the notches 516 of the annular projection 515 into the stop connecter 51 and then into the upper cover body 61 of the second stop valve 6 through the through passageway 511, and synchronously push open the soft pad 611 in the upper cover body 61 and flow into the second stop valve 6 and than into the air intake pipe 63.

Figure 14:
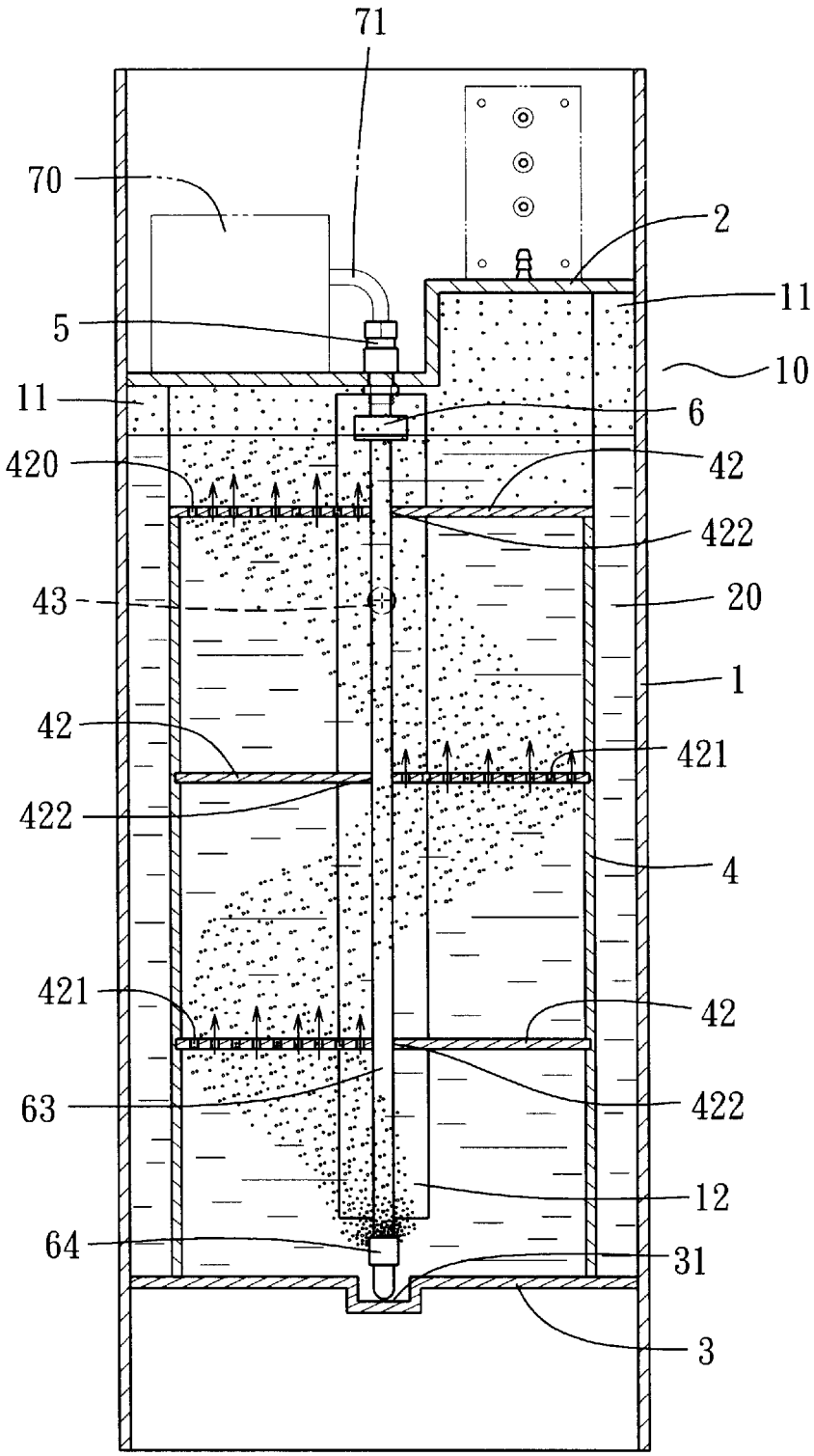
FIG. 14 is a side view of the container in a condition of injecting in air in the present invention.

When the current of air gets into the end portion of the air intake pipe 63, as shown in FIG. 13, it pushes apart the ball 643 in the exhausting sleeve 64, letting the spring 642 contracted and then gets into the liquid oil 20 in the gasification box 4 through the numerous minute holes 641 of the exhausting sleeve 64. And, after passing through these minute holes, the aforesaid air forms a great many of densely minute bubbles, which will rise up to reach the bottom side of the separating plate 42 and then pass through the air releasing holes 421 of each separating plate 42 along a roundabout route formed among the separating plates 42 and then get out of the exhausting holes 421 of the uppermost separating plate 42 and lastly flow into the container 1, as shown in FIG. 14.

In addition, the large quantity of minute bubbles exhausted from the sleeve 64 can be completely mixed with the liquid oil 20 due to a comparatively long-term mutual contact caused by an S-shaped twisting route in the gasification box 4, resulting in elevating the degree of gasification as well as increasing the density of the oil gas and also permitting the oil gas concentrated on the upper surface of the liquid oil 20.

On the other hand, when the motion of injecting in air makes the oil gas in the container 1 sufficient to reach a pressure value predetermined, the pressure of the oil gas in the container 1 becomes greater than that in the air intake pipe 63, thus, the spring 642 in the exhausting sleeve 64 will recover to push the ball 643 to close up the intake pipe 63, as shown in FIG. 8, letting the air in the intake pipe 63 unable to get out of the exhausting sleeve 64 but accumulate within the intake pipe 63. Thus, such increasingly accumulated air will make the pressure inside become great enough to push the air in the intake pipe 63 to flow back to the lower cover body 62 of the second stop valve 6 and then push the soft pad 611 to rest against the bottom side of the upper cover body 61 with its projection 612 closing up the through passageway.

Under this condition, the air compressed by the air pump 7 cannot get into the second stop valve 6 any longer but just stay in the air stop connecter 51 of the stop valve 5, and thus, the spring 52 in the stop connecter 51 of the stop vale 5 recovers to push against the stop cap 53 to close up the outlet of the passageway of the air intake connecter 54, as shown in FIG. 8, letting the air compressed by the air pump 7 unable to get into the air intake pipe 63 of the stop valve 5, resulting in the air in the exhausting pipe 71 flowing back to let the power of the air pump 7 cut off automatically. Thus a round of pumping air into the container 10 ends. And the air pump 7 may electrically be operated again to repeat the motion of injecting in air only when the stop threaded rods 236 of the ramifying control box 23 are turned to move out to let the oil gas inside flow out for use and the alarm device 8 has detected that the pressure of oil gas inside is insufficient.

Figure 15:
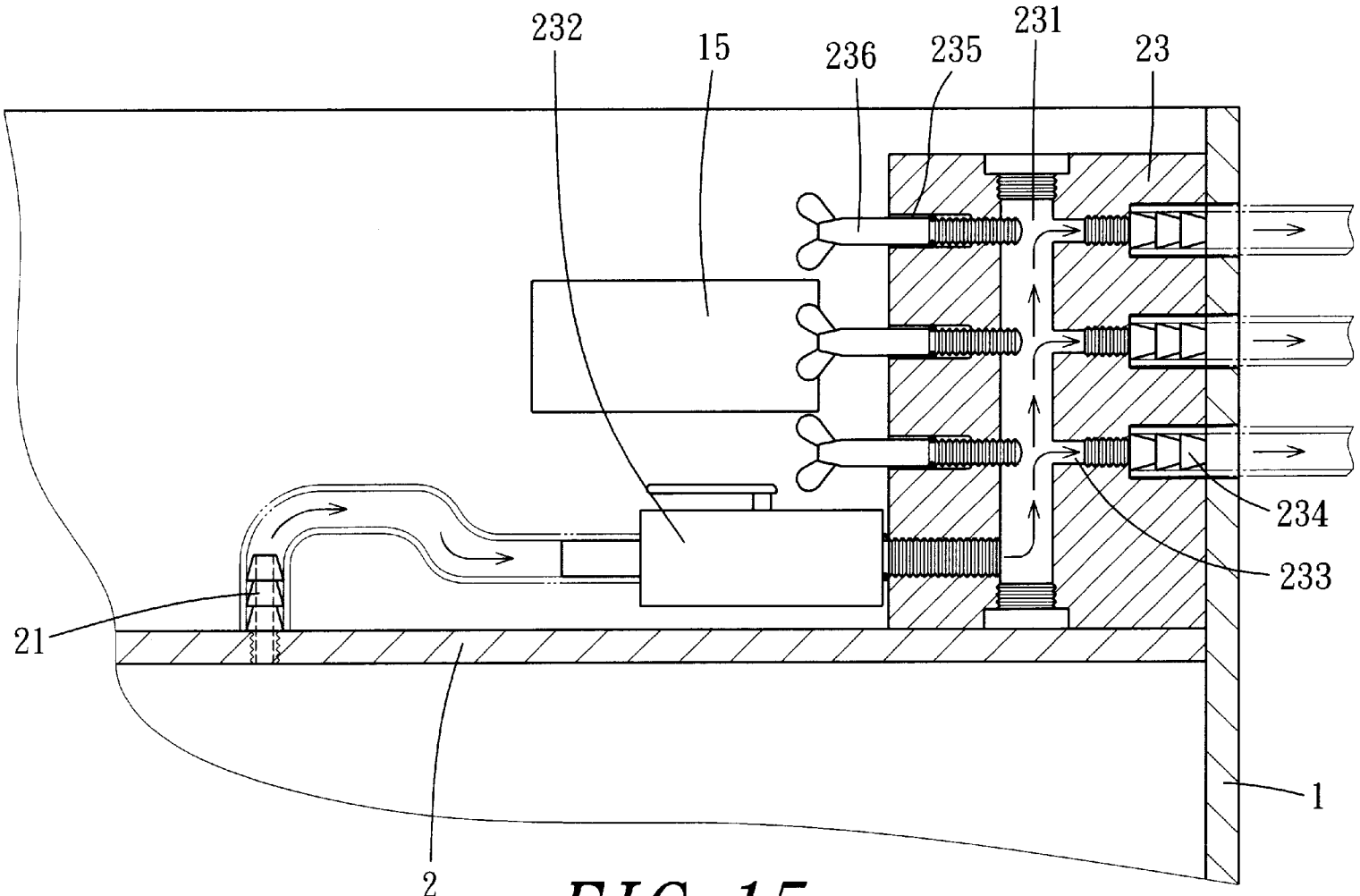
FIG. 15 is a cross-sectional view of the ramifying control box with its stop threaded bolts and the control valve turned open in the present invention.
Figure 16:
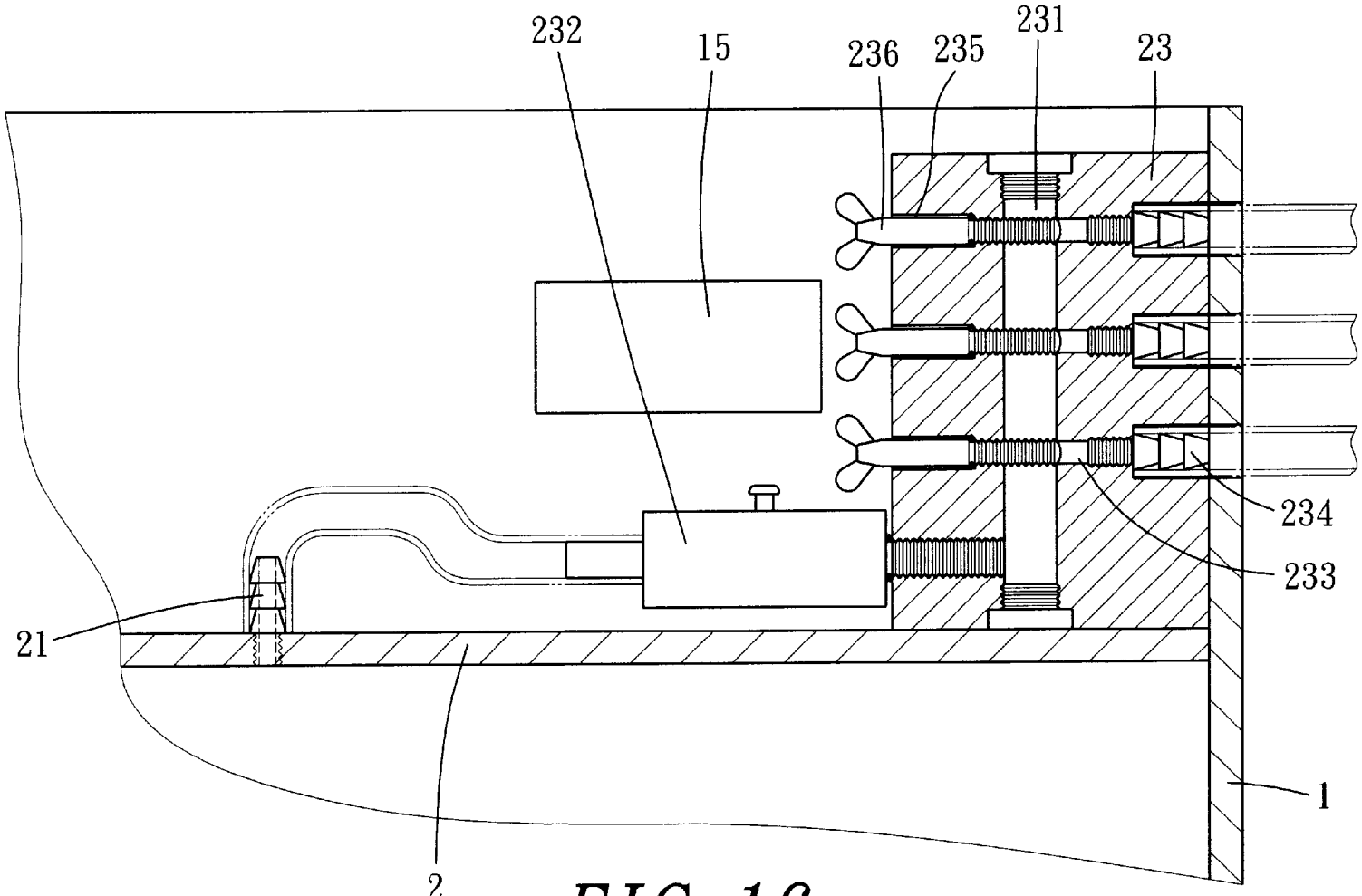
FIG. 16 is a cross-sectional view of the shunt control box with its stop threaded bolts and the control valve turned closed in the present invention.

Furthermore, after the oil gas mixed smoothly gathers under the top cover 2, it will flow into the shunt control box 23 through the air nozzle 21 of the top cover 2, as shown in FIG. 15. In case of using, just turn open the control valve 232 of the main intake passageway 231 and then, depending on practical demands of use, turn apart all or only one of the threaded rods 236 of the shunt passages 233 to form intercommunicating passages in the shunt control box 23 for oil gas to flow out smoothly. On the contrary, after used, turn closed the control valve 232 outside the main intake passageway 231 and also the stop bolts 236 of the ramifying passageways 233, as shown in FIG. 16. In consequence, all the through passageways are closed up and the oil gas inside cannot flow out. Besides, the gasket 237 fitted around each stop threaded rod is capable to allow the ramifying control box 23 kept in closed condition, no matter the passages inside communicate with one another or closed, thus effectively preventing the oil gas inside from leaking out along the stop threaded holes 235.

Figure 17:
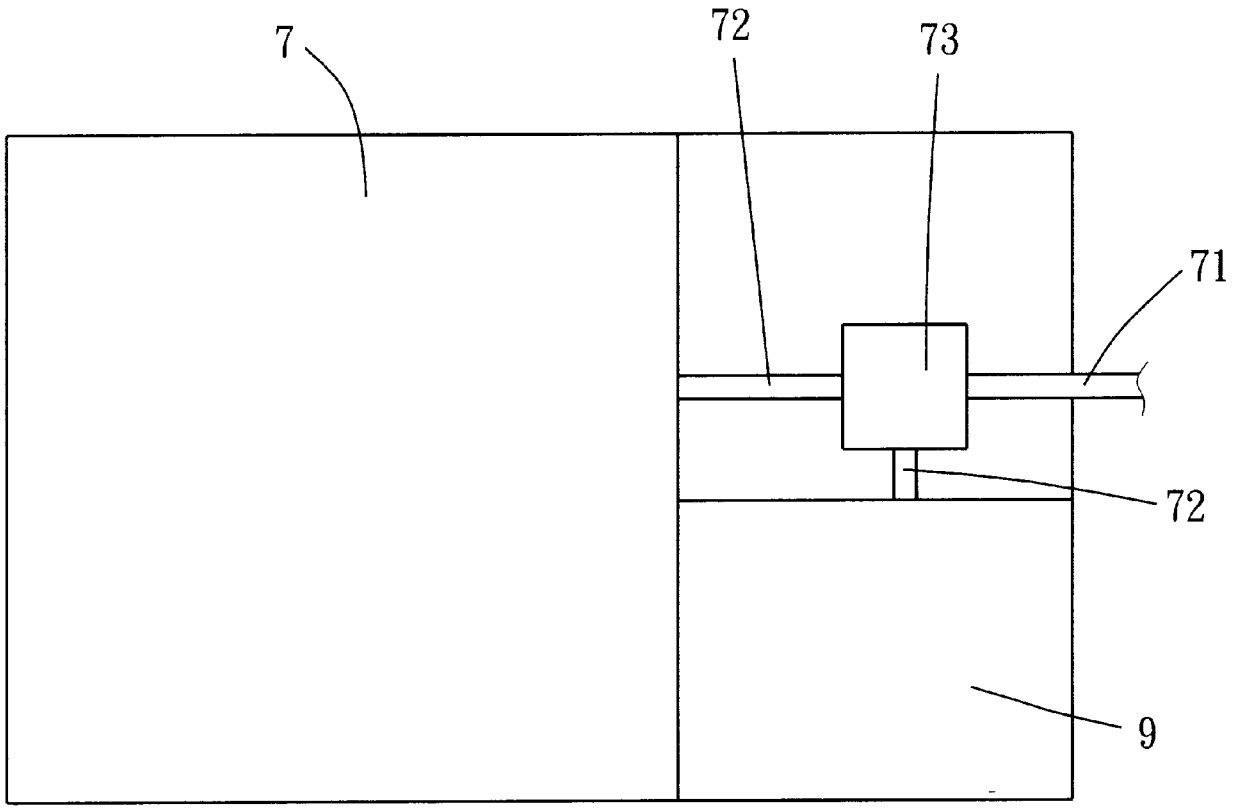
FIG. 17 is a cross-sectional view of an air pump in the present invention.

Moreover, the air pump 7 can be electrically disconnected automatically as described above because an air filling switch 9 capable to turn off the power supply of the air pump 7 is additionally provided in this invention, as shown in FIG. 17. The exhausting pipe 72 of the air pump 7, after passing a tri-way connecter 73, is connected respectively to the air filling switch 9 inside and the exhausting pipe 71 outside; such a design prevents the air in the exhausting pipe 71 from flowing back to the air filling switch 9 if the air inside can be sent out smoothly.

Figure 18:
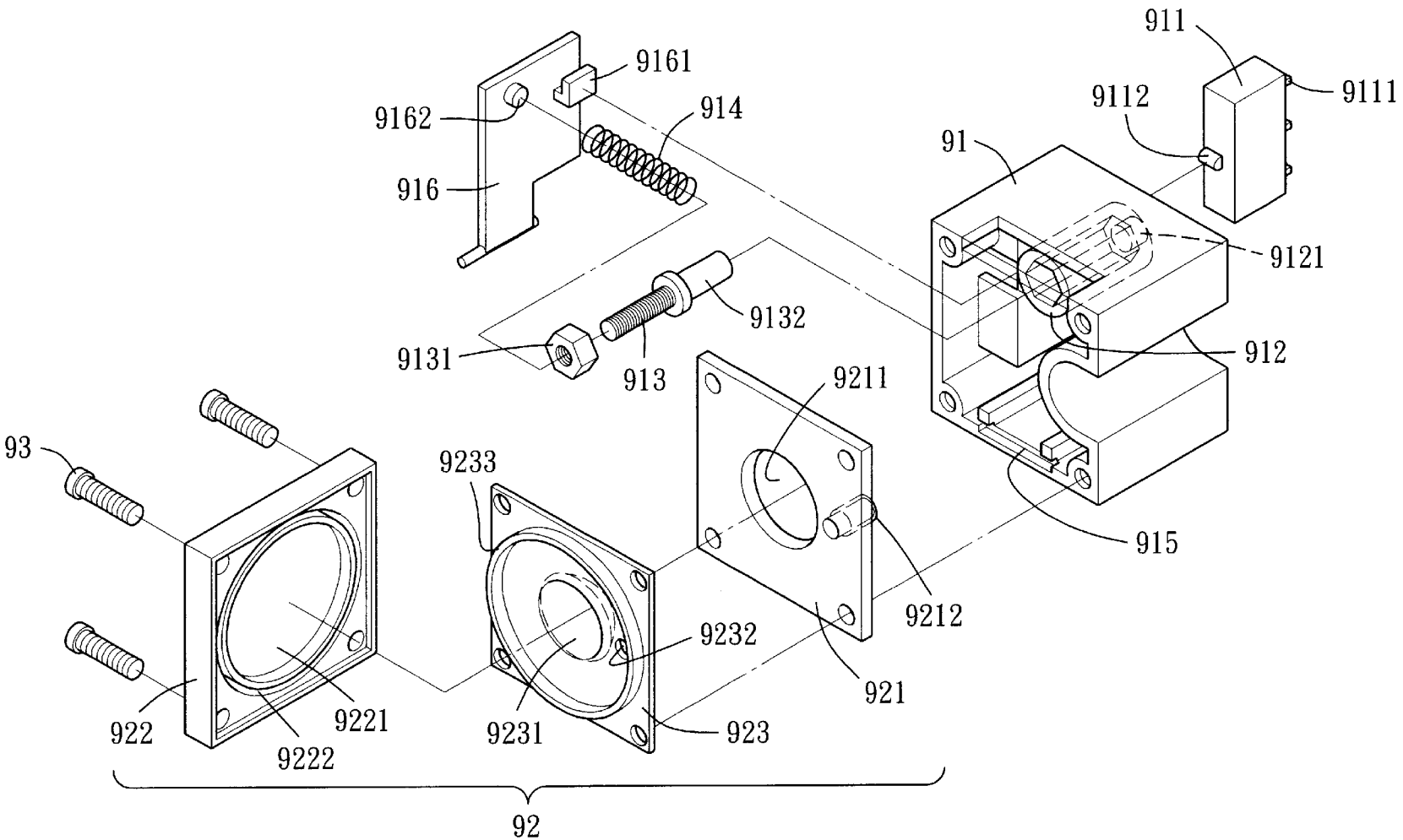
FIG. 18 is an exploded perspective view of an air-filling switch in the present invention.

The air-filling switch 9, as shown in FIG. 18, consists of a box body 91 and an air-filling unit 92 combined together. The box body 91 is fixedly provided with a micro-motion switch 911 having plural feet 9111 respectively connected with the air-filling pump 7 and with power. A projection 9112 facing the open side of the box body 91 is fixed on front side of the micro-switch 911, and a hollow hexagon sleeve 912 is formed in the interior of the box body 91, protruding toward an open side of the box body 91. Then, a small through hole 9121 is bored on the wall of the box body 91 at the bottom of the sleeve 912, and a threaded rod 913 with a hexagon nut 9131 is positioned inside the hollow hexagon sleeve 912 of the box body 91.

Further, the threaded rod 913 has its adjusting head 9132 protruding out of the box body 91 through the through hole 9121 and a spring 914 fitted around its rod body. Then, an engage groove 915 is formed at the lower end of the open side of the box body 91, and a press plate 916 has its lower end engaged movably in the engage groove 915. Besides, one side of the press plate 916, facing the box body 916, is provided with a press member 9161 facing a projection 9112 and the spring 914 facing the projection 9162 to fit around and rest against the press plate 916.

The air-filling unit 92 is fixed with the box body 91 on an open side, composed of an inner and an outer clamp member 921 and 922 and a pad member 923 sandwiched between the two clamp members 921, 922. The inner clamp member 921 has a through hole 9221 bored in center and an air intake valve 9212 provided near its edge. The outer clamp member 922 has a chamber 9221 with an annular engage groove 9222 around its circumferential edge. The pad member 923 has an air cave 9231 with its inflated portion facing the box body 91 and passing through the through hole 9211 of the inner clamp member 921 and an air intake hole 9232 conforming to the air intake valve 9212 of the inner clamp member 921 is formed beside the air cave 9231, and further an annular projection 9233 is fitted in the annular engage groove 9222, facing the outer clamp member 922.

Figure 19:
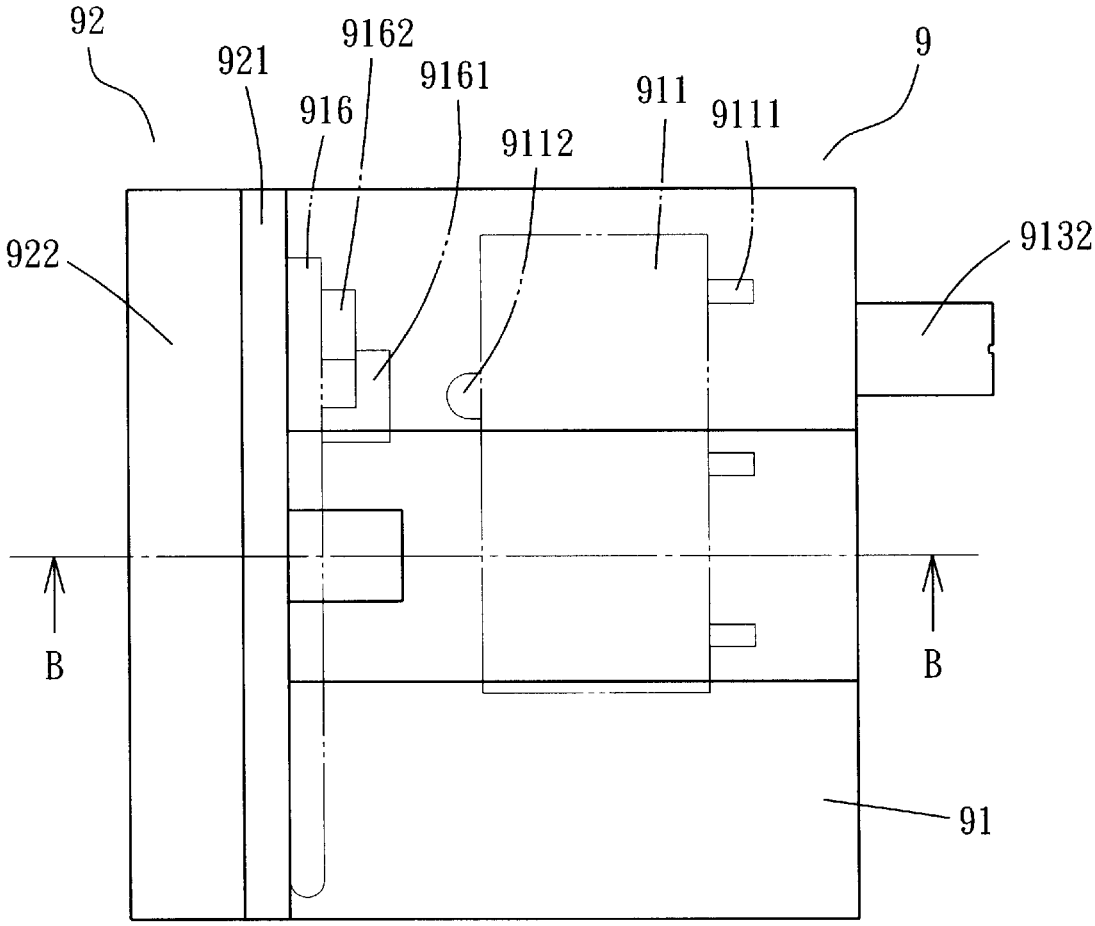
FIG. 19 is a front view of the air-filling switch in the present invention.
Figure 20:
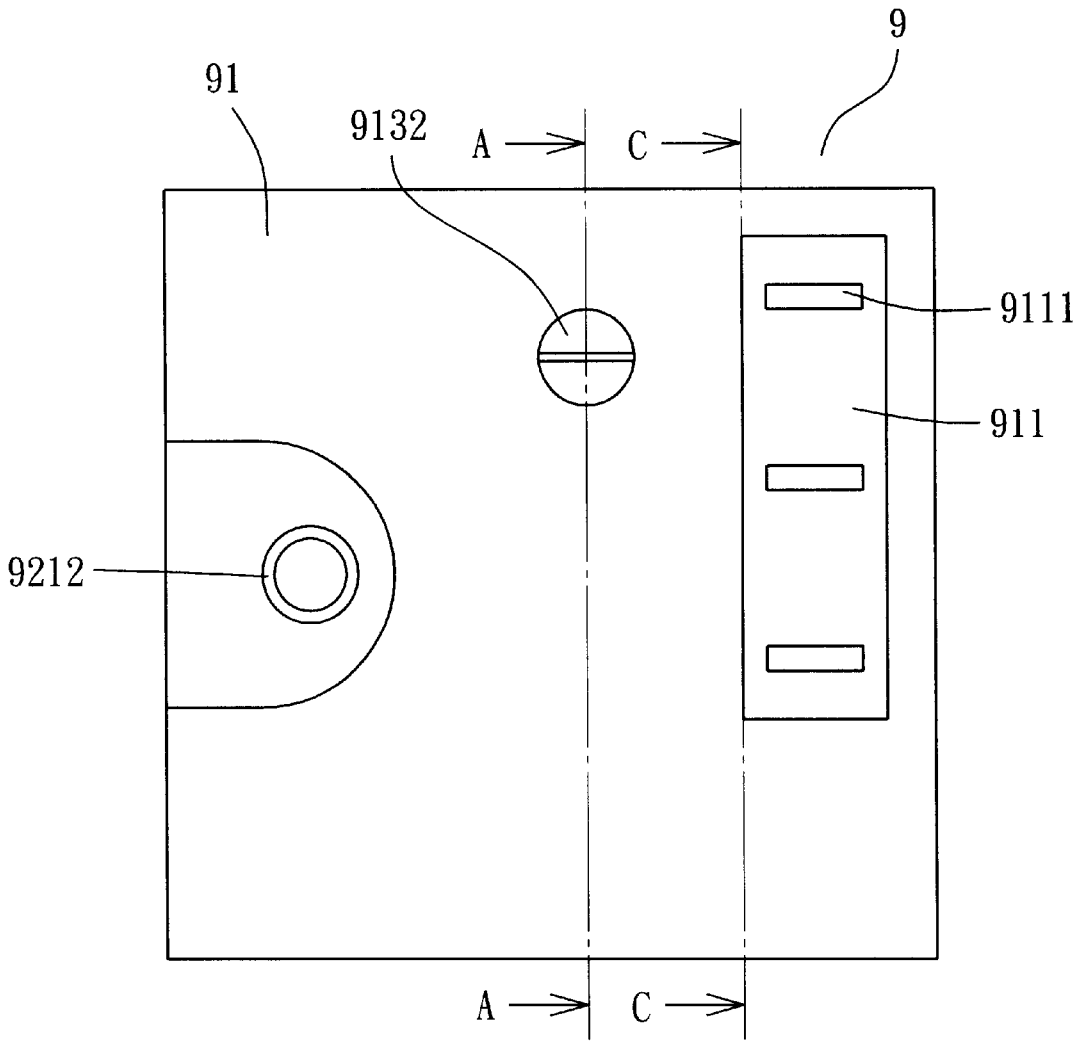
FIG. 20 is a rear view of the air-filling switch in the present invention.
Figure 21:
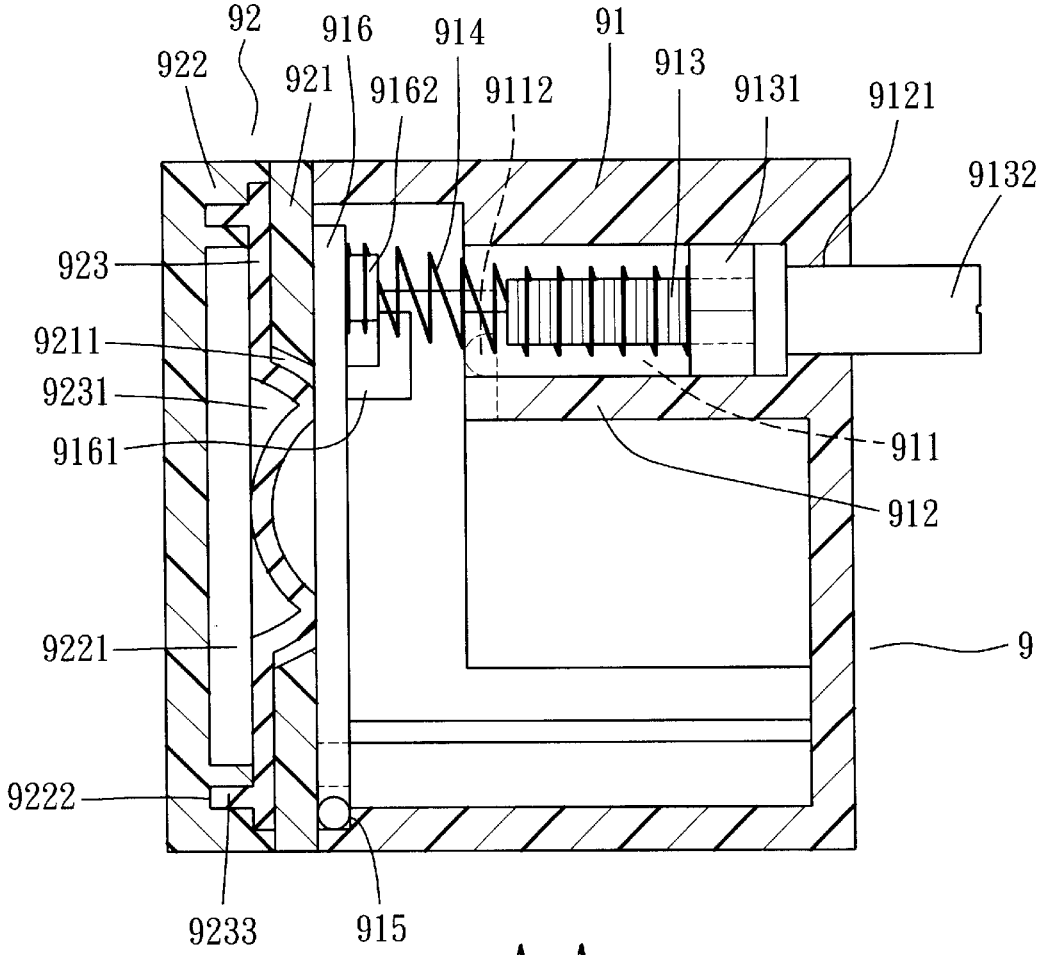
FIG. 21 is side cross-sectional view of the line A—A line in FIG. 20.

In assembling the air filling switch 9, as shown in FIGS. 19, 20, 21 and 22, firstly, the micro-switch 911 is secured in the box body 91, with its projection 9112 facing the open side of the box body 91, as shown in FIG. 19, its feet 9111 face outward for connecting with the air pump 7 and the power supply, as shown in FIG. 20. Then, the nut 9131 and the threaded rod 913 are screwed together and fitted in the sleeve 912 in the box body 91, with the adjusting head 9132 of the threaded rod 913 passing through the through hole 9121 and protruding out of the box body 91, as shown in FIG. 21. The spring 914 is fitted around the rod body of the threaded rod 913, the bottom edge of the press plate 916 engaged in the engage groove 915 of the box body 91 with the press member 9161 facing the projection 9112 of the micro 1 switch 911 and having the spring 914 fitted in place with the projection 9161, as shown in FIG. 21.

Figure 22:
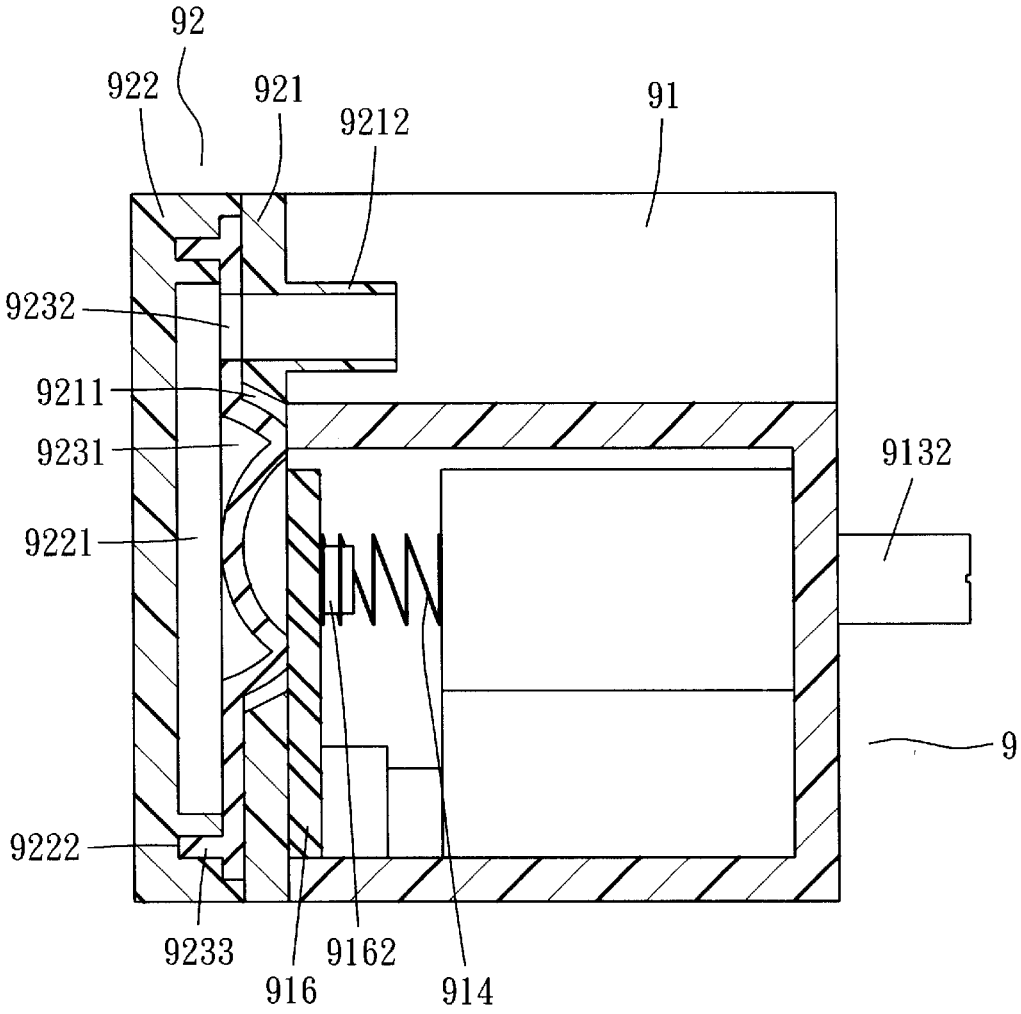
FIG. 22 is a side cross-sectional view of the B—B line in FIG. 19.

Next, the pad member 923 of the air filling unit 92 is positioned between the inner clamp member 921 and the outer clamp member 922, with its air cave 9231 protruding out of the through hole 9211 of the inner clamp member 921 and facing the press plate 916 of the box body 91 and its annular projection 9233 on the other side engaged in the annular engage groove 9222 of the outer clamp member 922. Further, the exhausting mouth 9212 of the inner clamp member 921 and the air intake hole 9232 of the pad member 923 are aligned to each other, communicating with the chamber 9221 of the outer clamp member 922, as shown in FIG. 22.

Then, the inner clamp member 921 of the air-filling unit 92 is stabilized to contact the open side of the box body 91 by means of bolts 93, as shown in FIG. 18. Thus, the spring 914 will push against the press plate 916 making the protruding side of the air cave, 9231 in the through hole 9211 of the inner clamp member 921 become flat without any air in it, as shown in FIGS. 21 and 22.

In accordance with the design described above, when the air compressed by the air filling pump 7 gets into the oil container 10 and fills up the container body in saturated condition or the pressure inside has reached a preset value, and the air intake pipe 63 and the first stop valve 5 as well as the second stop valve 6 are all closed up, the air compressed continually by the air filling pump 7 will flow back through the tri-way connecter 73 to the exhausting pipe 72 and into the air intake mouth 9212 of the air filling switch 9, and then gas will pass through the intake valve 9212 of the inner clamp member 921 and the intake hole 9232 of the pad member 923, and subsequently, flow into the chamber 9221 of the outer clamp member 922, gradually filling up the chamber 9221 and the air cave 9231 of the pad member 923.

Figure 23:
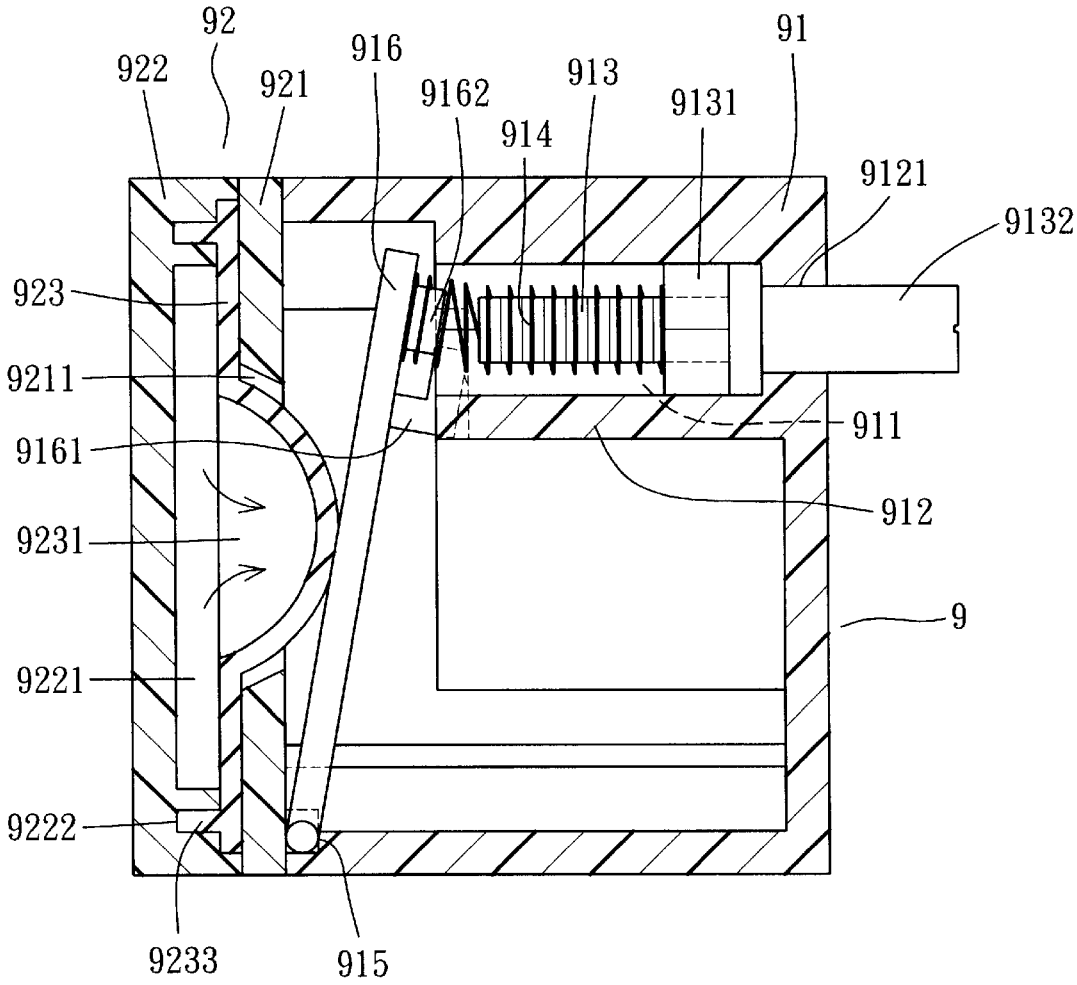
FIG. 23 is a side cross-sectional view of the air-filling switch in a condition of filling in air in the present invention.
Figure 24:
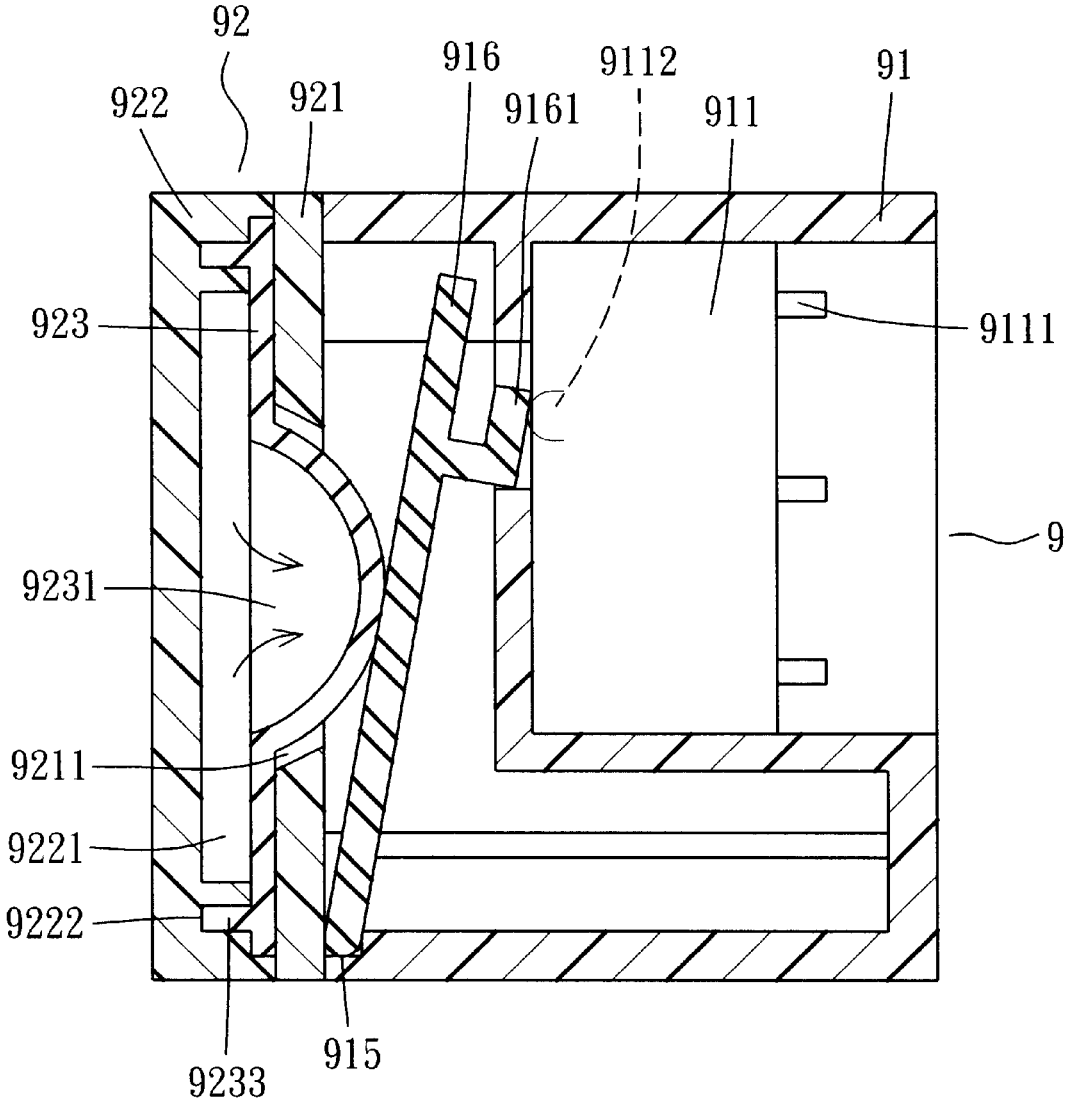
FIG. 24 is a side cross-sectional view of the line C—C in FIG. 20, showing the air-filling switch in a condition of filling in air.

As a result, the air cave 9231 gradually becomes inflated, protruding out to push the press plate 916 rest slantingly against the micro-switch 911, as shown in FIG. 23, letting the press plate 916 press the spring 914 and also, by means of its press member 9161, press down the projection 9112 of the micro-switch 911, as shown in FIG. 24. Then the projection 9112 moves into the micro-switch 911 to make electric disconnection, cutting off the circuit of the power supply of the air filling pump 7. Thus the air-filling pump 7 will automatically stop flow of compressing air, not filling in air any longer. At this moment, the air in the chamber 9221 and in the air cave 9231 will gradually flow out through the air intake valve 9212, and the spring 914 will recover to push the press plate 916 to press the air cave 9231, letting the air in the air cave 9231 completely exhausting out, as shown in FIGS. 21 and 22. It is evident as that the air-filling switch 9 is capable to cut off electricity automatically. So, in the process of filling in air, there is no need for a user to stand waiting, nor to turn off the power supply by hand, convenient in handling.

Figure 25:
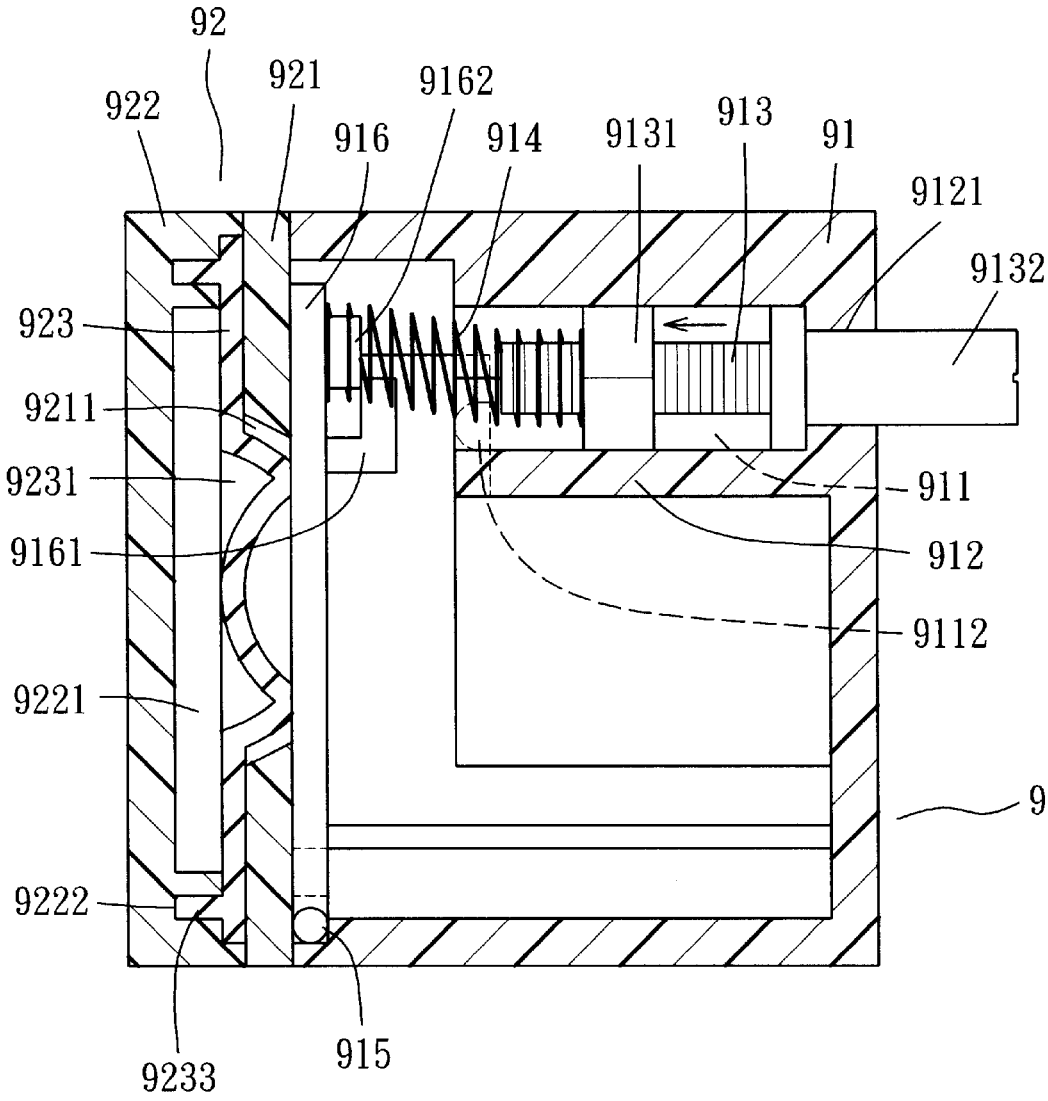
FIG. 25 is a side cross-sectional view of the air-filling switch in an adjusting condition in the present invention.

Aside from having a function of automatically turning off power supply, the air-filling switch 9 has a function of micro-adjustment as well. To make the oil gas in the container 10 highly saturated or to increase pressure value of the container body, only turn around the adjusting head 9132 of the threaded rod 913 to let the nut 9131 in the sleeve 912 move linearly toward the press plate 916 along the hexagon inner wall of the sleeve 912, as shown in FIG. 25, with the spring 914 pressed to push against the press plate 916. Under this condition, a great quantity of air is required to flow back to the air cave 9231 so as to produce pressure large enough to push the press plate 916 back to cut off power. By the same principle, in case of expecting to lower the saturation degree or the pressure value in the container 10, just turn around the threaded rods 913 to let the nut 9131 move back from the press plate 916. As can be noted, the air-filling switch 9 of this invention has a function of micro-adjustment and many options to select.

Figure 26:
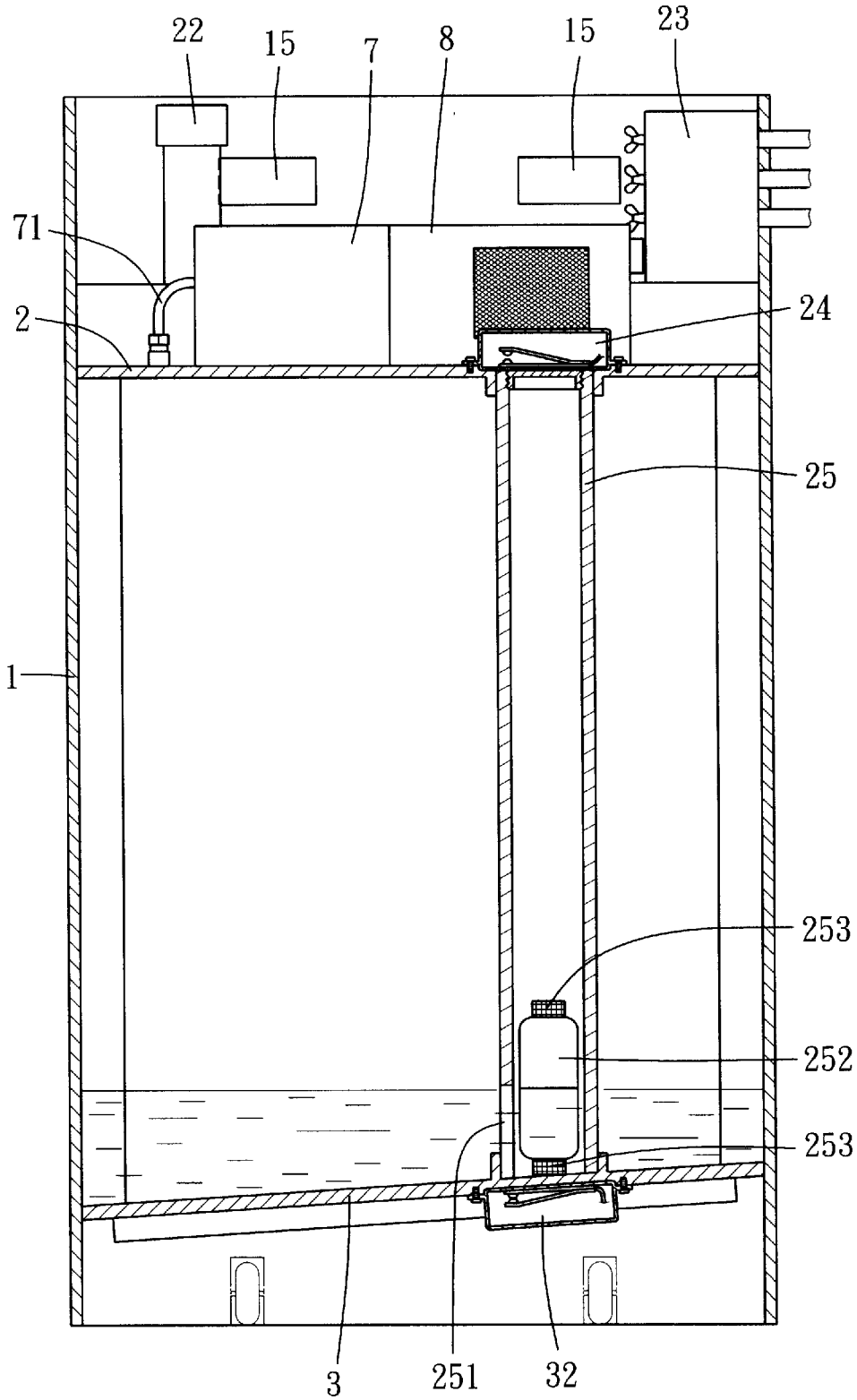
FIG. 26 is a first cross-sectional view of a quantity detecting tube in motion in the present invention.
Figure 27:
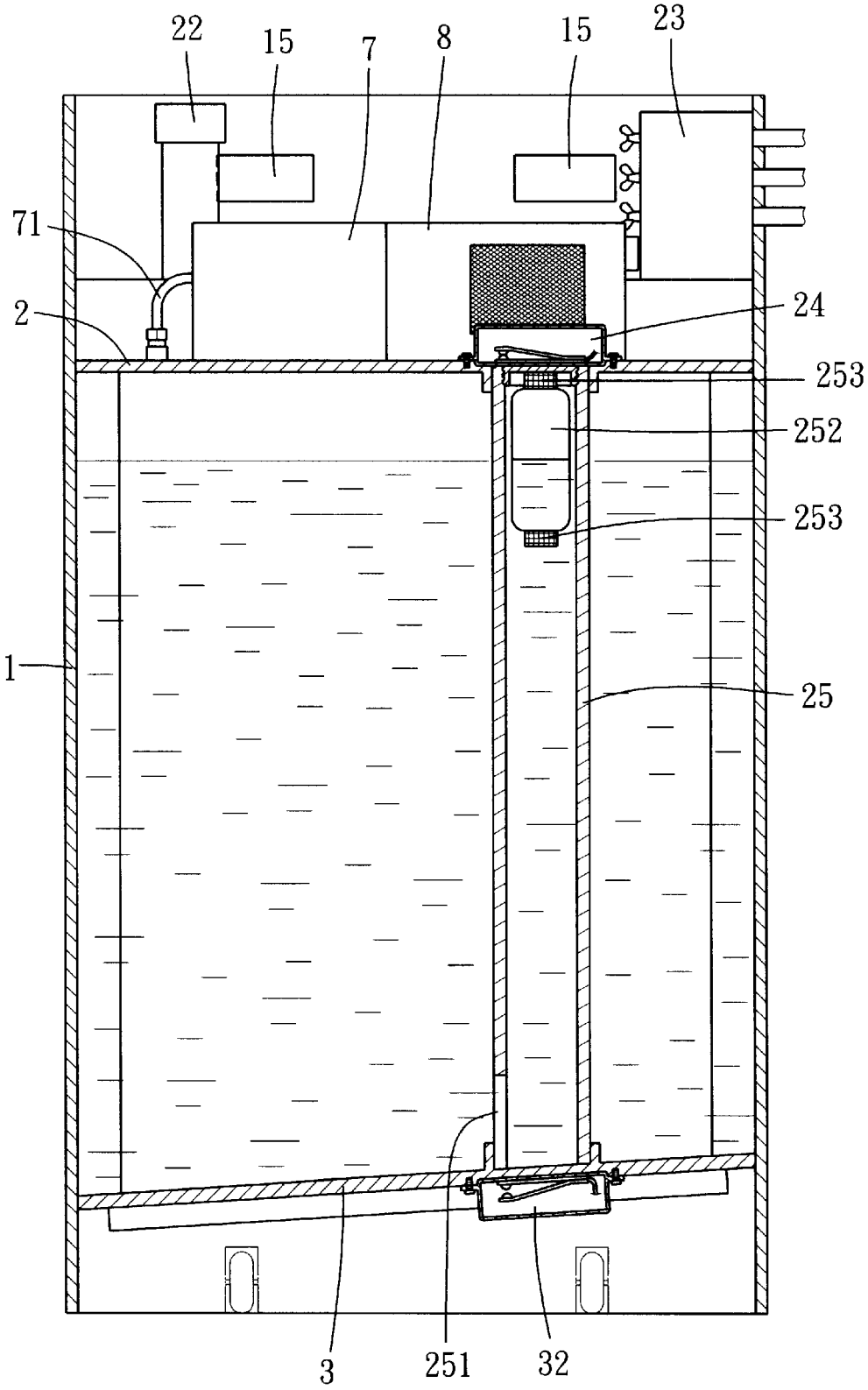
FIG. 27 is a second cross-sectional view of the quantity detecting tube in motion in the present invention.
Figure 28:
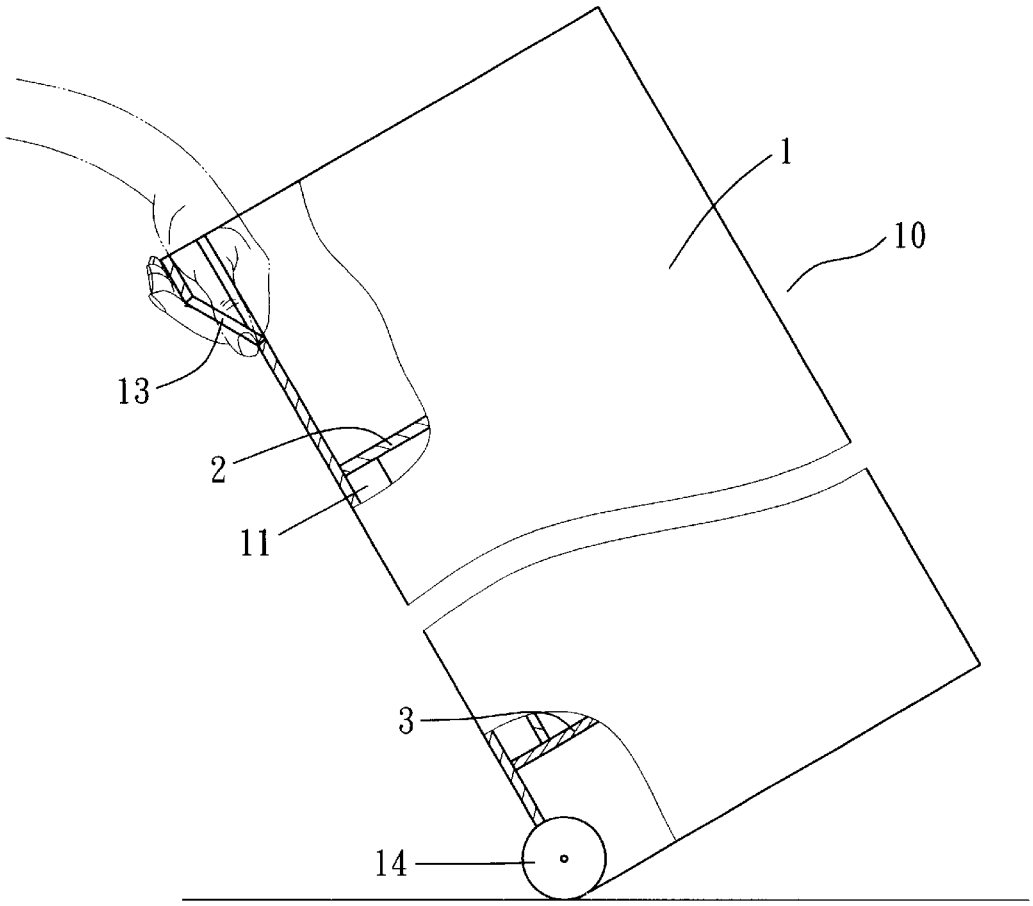
FIG. 28 is a perspective view of the container in a condition of being carried around in the present invention; and, FIG. 29 is a side view of the container being hung on a wall in the present invention.
Figure 29:
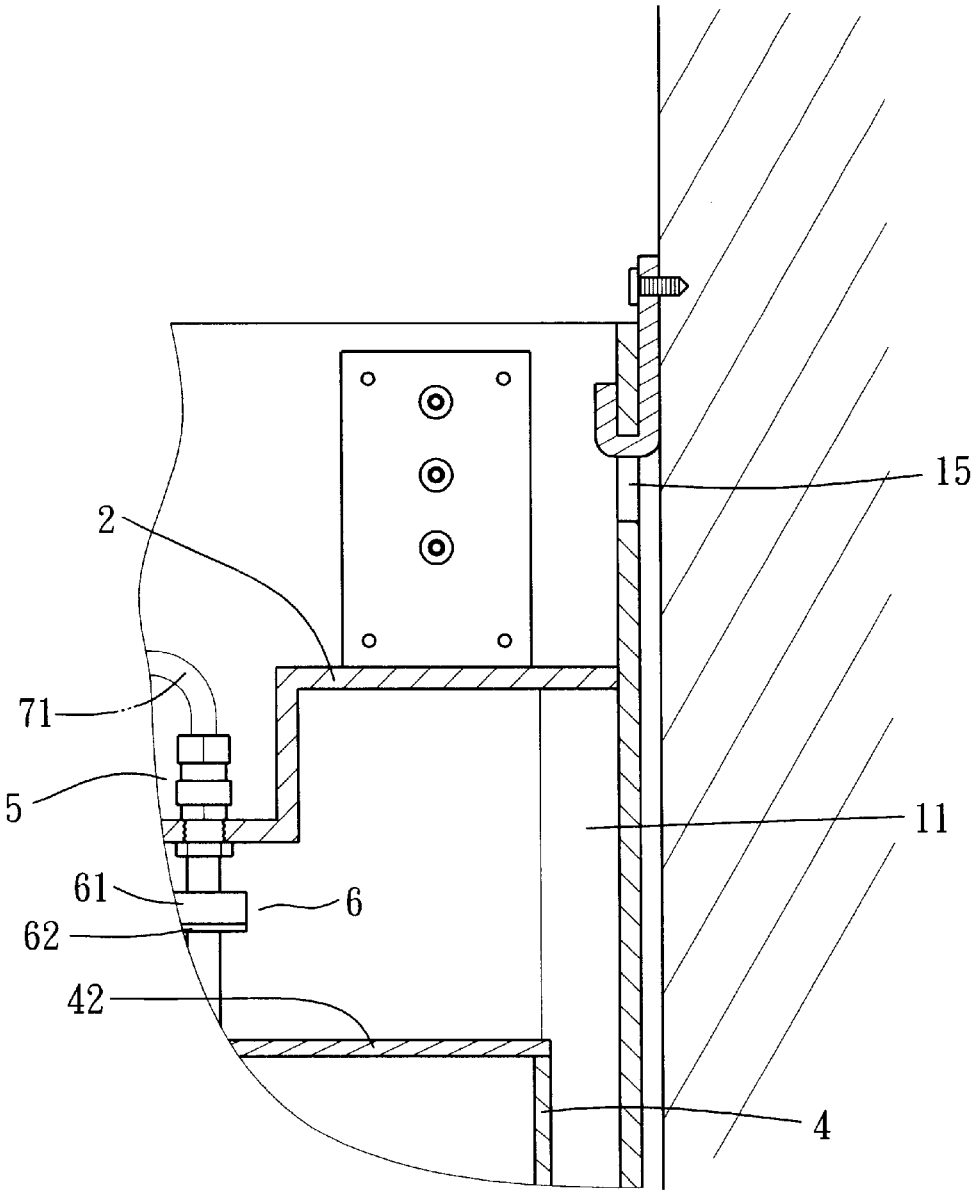

In addition, the alarm device 8 has a function of detecting the oil quantity inside the container 10 by means of the quantity detecting tube 25 provided in the alarm device 8. When the liquid oil 20 inside the container 10 is used up, the oil surface together with the buoy 252 in the quantity detecting tube 25 will move down close to the upper portion of the bottom cover 3, with the magnet 253 under the buoy 252 moving close to a contact switch 32 positioned under the bottom cover 3, attracting and contacting with the feet of the contact switch 32 to turn on the alarm device 6 so as to send out warning sound, reminding the user to fill in liquid oil, as shown in FIG. 26. On the contrary, when liquid oil 20 is filled into the container 10, the oil surface together with the buoy 252 will rise up, and when the buoy 252 move up near the top cover 2, the magnet 253 fixed on the buoy 253 attracts the contact switch 24 on the top cover 2, as shown in FIG. 27, and at the same time, the adapter of the contact switch 24 contacts with the alarm device 8, which is then turned on to send out alarm sound to remind the user to stop filling in oil to prevent the oil from overflowing.

As can be understood from the above description, the liquid oil container in this invention has the following advantages and functions.

1. The container body 1 is made of aluminum formed by squeezing without need of repeated compression by rollers, easy in manufacturing, lowering its cost, light in weight and elegant in appearance.

2. The gasification box 4 disposed in the container body 1 enables the air injected and mixed completely with the liquid oil, effectively elevating the degree of gasification and density of oil gas.

3. The air exhausting sleeve 63 and the two stop valves 5 and 6 provided respectively in the container 10 and on the top cover 2 prevent the pressure value in the container 10 from rising too high by injecting too much air, and besides, the air filling switch 9 fitted in the air pump 7 is capable to turn off the power supply automatically, preventing the air pump 7 from compressing too much air which will flow back and may damage the air pump 7, safe and convenient in using.

4. The air filling switch has a capacity of micro-adjustment to adjust the pressure needed in the container body 1, having functions of flexibility and facility.

5. The bottom cover 3 is formed in a slanting shape to let the liquid oil in the container 10 to be used completely, and the quantity detecting tube 25 and the buoy 252 provided in the container 10 are capable to detect whether the oil in the container 10 is nearly used up or is fully filled in so as to remind a user to refill oil in time or to stop filling, preventing oil from overflowing.

6. The ramifying control box 23 is provided with plural stop bolts 236 capable to control the oil gas inside to flow out or not by turning open all or only one of the ramifying passageways 233, convenient in using.

While the preferred embodiment of the invention has been described above, it will be recognized and understood that various modifications may be made therein and the appended claims are intended to cover such modifications that may fall within the spirit and scope of the invention.

I claim:

1. A container for liquid oil of energy comprising:

a container body made of aluminum squeezed into a tubular shape, having a hollow interior communicating its top with its bottom, plural vertical support posts and a dovetail-shaped projection formed integral on the inner walls of said container body for a top and a bottom cover to be fixed thereon, a gasification box having a dovetail-shaped groove fitted with said dovetail-shaped projection;

said gasification box having a plurality of horizontal separating plates provided spaced apart inside, each said separating plate having numerous air exhausting holes formed on a half portion but not facing each other and a through hole for an air intake pipe to insert in, said gasification box disposed on said bottom cover of said container in order to allow liquid oil in said container to flow into said gasification box through a groove of said bottom cover, letting the surface of said liquid oil in said gasification box flush with that in said container, air injected in through said air intake pipe, and passing through an air exhausting sleeve and formed into a great many of minute bubbles which will get into said liquid oil in said gasification box, then rise up to the bottom of each said separating plate and get into said container body through said air exhausting holes of each said separating plates, arranged in an S-shaped twisting route among said separating plates, letting the air injected in said liquid oil in said container mix completely so as to promote degree of gasification and density of oil gas;

said top cover matching with said hollow interior of said container body, and formed into a step-shaped cover body and fitted stably on said support posts and said air intake pipe in said container, said top cover provided with an air nozzle and an air filling pipe, said exhausting mouth connected to a ramifying control box; said ramifying control box having a main air intake passageway formed in the interior with plural ramifying passageways, said main intake passageway having its end assembled with a control valve connected to said air nozzle of said top cover, said main air intake passageway in said intake control box having its said ramifying passageways respectively provided with an air nozzle for soft pipes to fit with, plural stop threaded holes provided at an opposite side of each said ramifying passageway respectively communicating with each said ramifying passage, each said stop threaded hole threadably fitted inside with a stop bolt, which is fitted with a gasket capable to close up said main intake passageway and said ramifying passages;

a stop valve provided at a point of said top cover facing said gasification box, said stop valve having a stop connecter firmly screwed with said top cover and connected to said intake tube of said container body, said stop connecter having its interior formed with a through passage and having a stepped surface inside with female threads at one end opposite to said top cover, said stepped surface of said stop connecter fitted with a coil spring covered and stopped by a stop cap with its opening facing said stop connecter, said stepped surface of said stop connecter also threadably fitted with an air intake connecter, which has a hollow through interior and a recess at the end receiving said top cover, said air intake connecter having its other end connected with an air exhausting pipe of an air filling pump, said air filling pump disposed on a low stepped portion of said top cover and having its said exhausting pipe connected to said stop valve of said top cover, said stop valve having its end portion protruding into said container body to be connected with a second stop valve which has its end connected to an air intake pipe, said air intake pipe extending into the bottom of said gasification box and having its end fixedly provided with said air exhausting sleeve capable to produce extremely minute bubbles, said exhausting sleeve having a great number of fine holes bored on a top surface and communicating with said air intake pipe, a spring and a ball positioned inside, said ball pushed by said spring to close up the outlet at the end of said air intake pipe;

a contact switch stably fixed on said top cover, a quantity detecting tube matching with said contact switch and inserting into said container body on the bottom of said top cover, said quantity detecting tube having an opening at bottom and a buoy positioned inside, said buoy having a magnet fixed on top and a bottom; and, said bottom cover matching with a hollow interior of said container body, and formed slanting down to one side and facing said air intake pipe, said bottom cover fixed on the bottom edges of said support posts in said container body and having a groove facing both said air intake pipe and said air exhausting sleeve in said container body, then another contact switch fixed exactly under the bottom of said quantity detecting tube.

2. The container for liquid oil of energy as claimed in claim 1, wherein an air filling switch to automatically turn off power is installed in said air filling pump, and said air filling switch has a box body containing a micro-switch inside, said micro-switch fitted having feet connected with power supply and a spring member fitted around a threaded rod, said micro-switch having a projecting button and a spring, and an adjusting head of said spring member positioned to face the open side of said box body, a press plate capable to bias to press both said projecting button and said spring of said micro-switch inserted in the open side of said box body and said spring member;

a press member facing said projecting button of said micro-switch and a projection corresponding to said spring member respectively fixed on one side of said press plate, facing to said box body;

an air filling unit having an air intake valve secured on the open side of said box body and provided with an air cave facing said press plate, capable to be inflated by filling in air; and, said air filling unit stably secured on the open side of said box body, said spring member pushing said press plate to let said press plate press the swollen side of said air cave to make it contracted flat, thus the returning air flowing through said air intake valve into said air cave of said air filling unit, said air cave becoming inflated and protruding toward said box body to push said press plate slant inward to press both said spring member and said projection of said micro-switch to cut off power.

3. The container for liquid oil of energy as claimed in claim 2, wherein said box body has its interior formed with a hollow hexagon sleeve, and a small through hole bored in the wall of said box body at the bottom side of said sleeve, and then a threaded rod threadably fitted with a hexagon nut and positioned in said sleeve, an adjusting head of said threaded rod protruding out of said box body through said through hole of said box body, said spring member having its one end fitted around said threaded rod and the other end resting against said press plate, thus, effectiveness of micro-adjusting obtained by turning around said adjusting head of said threaded rod to let said nut move back and forth so as to alter the pressure imposed on said spring by said nut and the pushing force imposed on said press plate by said spring member.

4. The container for liquid oil of energy as claimed in claim 2, wherein said air filling unit is composed of an inner clamp member, an outer clamp member and a pad member, said inner clamp member abutting against said box body and provided with a center through hole and an air intake valve at an outer side near said through hole, said outer clamp member having a chamber on one side facing said box body and communicating with said air intake valve and an annular engage groove formed around its outer circumference, said pad member having an air cave formed in a center and facing said box body and inflated extending through said through hole of said inner clamp member, an annular projection engaged in said engage groove of said outer clamp member and provided on one side of said pad member facing said outer clamp member, thus, said air will push said press plate slanting inward when the oil injected in flow into said chamber of said outer clamp member through an air intake mouth and gradually fills it up.

5. The container for liquid oil of energy as claimed in claim 1, wherein a front wall near the top edge of said container body is formed with an opening expanding outward, some sliding wheels are pivotally provided under the bottom of said container body for convenience of holding or moving around, and hang holes are also provided near the top edge of the rear wall of said container body, facilitating said container body to be hung on a wall.

* * * * *